US008002468B2

(12) United States Patent
Otsuka et al.

(10) Patent No.: US 8,002,468 B2
(45) Date of Patent: Aug. 23, 2011

(54) BAG WITH POURING SPOUT

(75) Inventors: Koji Otsuka, Hino (JP); Wakako Yoshimura, Kita-Ku (JP); Yasunori Honzawa, Suita (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 780 days.

(21) Appl. No.: 11/995,158

(22) PCT Filed: May 15, 2006

(86) PCT No.: PCT/JP2006/309666

§ 371 (c)(1),
(2), (4) Date: Jan. 9, 2008

(87) PCT Pub. No.: WO2007/017979

PCT Pub. Date: Feb. 15, 2007

(65) Prior Publication Data

US 2009/0129706 A1 May 21, 2009

(30) Foreign Application Priority Data

Aug. 11, 2005 (JP) ..... 2005-233538

(51) Int. Cl.
*B65D 30/16* (2006.01)
*B65D 30/08* (2006.01)

(52) U.S. Cl. ..... 383/104; 383/116; 383/906

(58) Field of Classification Search ..... 383/104, 383/116, 200, 906
See application file for complete search history.

(56) References Cited

U.S. PATENT DOCUMENTS

| | | | | | |
|---|---|---|---|---|---|
| 3,635,376 | A * | 1/1972 | Hellstrom | 222/107 |
| 3,782,601 | A * | 1/1974 | Krawagna | 222/107 |
| 3,815,810 | A * | 6/1974 | Wellman | 383/204 |
| 4,027,819 | A * | 6/1977 | Herrera-Gutierrez | 383/204 |
| 4,753,489 | A * | 6/1988 | Mochizuki | 383/33 |
| 5,005,734 | A | 4/1991 | Van Gordon et al. | |
| 5,312,189 | A | 5/1994 | Aeschbach et al. | |
| 5,433,526 | A * | 7/1995 | Wild | 383/35 |
| 6,667,081 | B1 * | 12/2003 | Aoki et al. | 428/34.1 |

FOREIGN PATENT DOCUMENTS

JP 05-132069 A1 5/1993

(Continued)

OTHER PUBLICATIONS

Machine translation of JP 11310248 A, translated on Sep. 10, 2010.*

(Continued)

*Primary Examiner* — Jes F Pascua
(74) *Attorney, Agent, or Firm* — Burr & Brown

(57) ABSTRACT

There is provided a bag with a pouring spout that can surely improve opening properties and shape retention of a spout port part without the need to render the spout port part bulky, can prevent clogging of the spout port part caused by flexing of the spout port part, and can reliably and easily spout the contents of the bag. The bag with a pouring spout comprises a narrow-width spout port part provided at one end of a laminated film bag, characterized in that in the region of the spout port part, a tape shaped sheet material, which has been cut into a desired length, is applied to the inner surface of at least one of the laminated films provided on both respective sides of the bag.

7 Claims, 17 Drawing Sheets

FOREIGN PATENT DOCUMENTS

| | | | | |
|---|---|---|---|---|
| JP | 11-079195 | A1 | | 3/1999 |
| JP | 11-152154 | A1 | | 6/1999 |
| JP | 11310248 | A | * | 11/1999 |
| JP | 11310253 | A | * | 11/1999 |
| JP | 2000153850 | A | * | 6/2000 |
| JP | 2000-238800 | A1 | | 9/2000 |
| JP | 2000-281093 | A1 | | 10/2000 |
| JP | 2004-338753 | A1 | | 12/2004 |

OTHER PUBLICATIONS

Machine translation of JP 11310253 A, translated on Sep. 10, 2010.*
Machine translation of JP 2000153850 A, translated on Sep. 14, 2010.*

* cited by examiner

BAG WITH POURING SPOUT

FIELD OF THE INVENTION

This invention relates to a bag with a spout port, for use as a container for a fluid material for refilling use. More particularly, the present invention relates to a bag with a spout port, which has improved easy opening properties and shape retention of its spout port and thus can easily spout contents of the bag.

BACKGROUND OF THE INVENTION

Containers for refilling use, in which a fluid material such as a liquid is hermetically packed and, in using the contents of the bag, is transferred into another container such as a bottle, preferably satisfies the requirements that the contents of the bag can be transferred easily and safely and, at the same time, the containers are inexpensive, the empty containers are not bulky, and the containers after use can be easily disposed of. For example, bags comprising, for example, a flat bag or a self-standing bag, formed by heat sealing a laminated film, and a narrow-width spout port, the periphery of which has been heat sealed, provided in a part of the circumference of the bag, have hitherto been used.

The above bags with a spout port are advantageously inexpensive and have excellent productivity, but on the other hand, they suffer from problems that the easy opening properties of the spout port and the shape retention of the opening are poor, the spout port is likely to be clogged in the course of spouting of the contents, and, thus, the suitability for spouting of the contents is poor.

Various studies have been made to solve the above problems, and bags improved in the suitability for spouting of the contents, for example, in the easy opening properties of the spouting part and the shape retention of the opening, have been proposed.

For example, a bag comprising a groove-shaped recess for forming a flow passage in a film material in a spout port of a bag, and a small tube such as a plastic small tube fixed in the groove-shaped recess for preventing the collapse of the flow passage and for withdrawing the contents of the bag through the small tube and emptying the bag has been proposed (see Japanese Patent Laid-Open No. 132069/1993 on pages 2 and 3, FIG. 1).

Further, a pouch for refilling, comprising a spout port part provided in a part of the upper part of a pouch, and a reinforcing member, provided in the internal face of the spout part, which is flat when mounted and, in use, is deformed to a tubular form to open the spout port part, has been proposed (see Japanese Patent Laid-Open No. 79195/1999 on pages 2 to 7, FIGS. 1 and 3).

The claimed advantage of the bag described in Japanese Patent Laid-Open No. 132069/1993 in which a groove-shaped recess is provided as a flow passage in a film material of a spout port part and a small tube having a certain level of hardness formed of, for example, a plastic molded product is fixed into the recess, is that the collapse of the flow passage can be reliably prevented and, at the same time, the contents of the bag can be spouted through the small tube.

However, in this bag, in providing a groove-shaped recess, the film material should be subjected to deep drawing in the course of the production of the bag, and, in inserting the small tube for fixation, spot welding is necessary. Accordingly, the production apparatus is complicated, and, at the same time, the production rate is also limited. Further, the small tube is hard and cylindrical, and the outer diameter should be not less than about 5 mm. Therefore, only the spout port part in the bag is bulky, and this is unsuitable in the handling or storage of an empty bag. Further, a special apparatus is also necessary for the feed apparatus of the empty bag in a filling sealing machine in the filling of the contents. Accordingly, the production equipment is complicated, and, at the same time, the production rate is reduced, resulting in increased production cost. Also from the viewpoint of quality, the above bag is disadvantageous in that, in some cases, the film material for the bag is damaged at the end of the small tube due to high hardness of the small tube.

Further, according to the pouch for refilling use described in Japanese Patent Laid-Open No. 79195/1999, a rigid sheet such as plastic is used as the reinforcing member. As shown in A-1, B-1 and C-1 of FIG. 3 in the above publication, the rigid sheet is fabricated, and the flat reinforcing member is applied to the inner surface of the spout port part in its predetermined part. In use, for example, pressing from both sides of the pouch toward the center part causes the reinforcing member to be deformed into an angular shape as shown in A-2, B-2, and C-2 in FIG. 3, and the spout port part can be opened in a prismatic form with good shape retention.

Even in the pouch for refilling, when the number of days of storage is long and is a few months or longer after the production, a high torque is necessary for gradually deforming the reinforcing member. This makes it difficult to deform the spout port part in use into a prismatic form.

SUMMARY OF THE INVENTION

The present invention has been made with a view to solving the above problems of the prior art, and an object of the present invention is to provide a bag with a pouring spout formed of a laminated film, into which fluid contents such as liquids have been packed in a hermetical sealing manner and, in use, are refilled into another container such as a bottle, and wherein the opening property and shape retention of the spout port part can be surely improved without the need to render the spout port part bulky, the film material for the spout port part is not damaged, and, at the same time, clogging of the spout port part, e.g., in its base by flexing can also be prevented, and the contents of the bag can be reliably and easily spouted. Another object of the present invention is to provide a bag with a pouring spout that can be produced with high productivity.

According to the present invention, there is provided a bag with a pouring spout, comprising a narrow-width spout port part provided at one end of a laminated film bag, characterized in that in the region of the spout port part, a tape shaped sheet material, which has been cut into a desired length, is applied to the inner surface of at least one of laminated films provided on both respective sides of the bag.

In an embodiment of the present invention, preferably, the laminated film and the tape-shaped sheet material applied to the laminated film have been thermoformed into a gutter shape which has been bulged outward in the bag and in which the laminated film and the tape shaped material have been welded to each other.

In another embodiment of the present invention, a convex-shaped streak is preferably provided on at least one of both-side edge parts on both edge sides of the tape-shaped sheet material.

In an embodiment of the present invention, a folding line formed by line pressing or thickness reduction of the sheet is preferably provided in the tape-shaped sheet material along the center line in its longitudinal direction.

In a preferred embodiment of the present invention, the tape-shaped sheet material is formed of a laminate of two or more layers, the layer applied on the laminated film side is formed of a thermal adhesive resin, and the layer on the other side is formed of either a resin having a melting point above the thermal adhesive resin or other thermoformable material.

In an embodiment of the present invention, preferably, the tape-shaped sheet material has been colored.

Further, in an embodiment of the present invention, preferably, easy opening means is provided in the spout port part at its opening position.

In an embodiment of the present invention, preferably, the bag with a pouring spout is a standing pouch-type bag, and the spout port part is provided at one corner part in the upper part of the bag.

The bag with a pouring spout according to the present invention has the following function and effect.

(1) Since the bag per se is formed of a laminated film, various properties required of the bag, for example, hermetical sealing properties, and, further, various strength properties and storage stability of the contents can be improved by selecting the construction of the laminate.

(2) In the spout port part region, a tape-shaped sheet material cut into a desired length is applied to the inner surface of at least one of the laminated films provided on both respective sides of the bag. By virtue of this construction, the rigidity of the spout port part can be enhanced, and, at the same time, in taking out the filled contents, the spout port part is automatically opened with good shape retention simply by cutting out the front end of the spout port part at its opening position. Accordingly, even when the contents of the bag are liquid, the contents can be smoothly spouted until the bag becomes completely empty, without causing clogging of the spout port part in the course of spouting.

(3) In the tape-shaped sheet material, the thickness can be properly regulated, and the material is not very hard. Therefore, the laminated films of the bag are not damaged. Further, the shape of the tub-shaped thermoformed spout port part is somewhat returned toward the shape before the thermoforming with the elapse of time but substantially remains unshaped. Therefore, there is no deterioration in opening properties of the spout port part.

(4) The application of the tape-shaped sheet material to the inner side of the laminated film provided on both respective sides of the spout port part followed by thermoforming of the assembly into an outward bulged gutter shape in which the tape-shaped sheet material has been welded to the laminated film, can allow the thermoformed gutters on both sides to be located so as to face each other. Therefore, the spout port part can be opened as a whole into a tubular form such as a cylindrical form with good shape retention, and the contents can be spouted more smoothly.

(5) The provision of the tape-shaped sheet material in a length extended from the opening position on the front end side of the spout port part to a part near the base of the spout port part can realize the effect of improving the opening property and shape retention of the spout port part. When the tape-shaped sheet material is provided to a length to a position which is further extended by about 10 to 30 mm from the base of the spout port part toward the center part of the bag, the clogging of the spout port part by folding of the spout port part in its part near the base can also be prevented. Therefore, the contents can be spouted more reliably and smoothly.

The bag with a pouring spout according to the present invention is suitable particularly for packaging bags for refilling use, in which liquid contents, for example, various household liquid detergents used, for example, in bathrooms, lavatories, and kitchens, as well as shampoos, conditioners, body soaps, and liquid seasoning agents, edible oils, and various beverages are packed in a hermetical sealing manner and, in use, are refilled into another container such as a bottle. Applications of the bag with a pouring spout are not particularly limited.

DETAILED DESCRIPTION OF THE INVENTION

Embodiments of the present invention will be described with reference to the accompanying drawings. However, it should be noted that the present invention is not limited to these drawings.

(1) Bag with Pouring Spout According to First Aspect of the Invention

Figure 1:
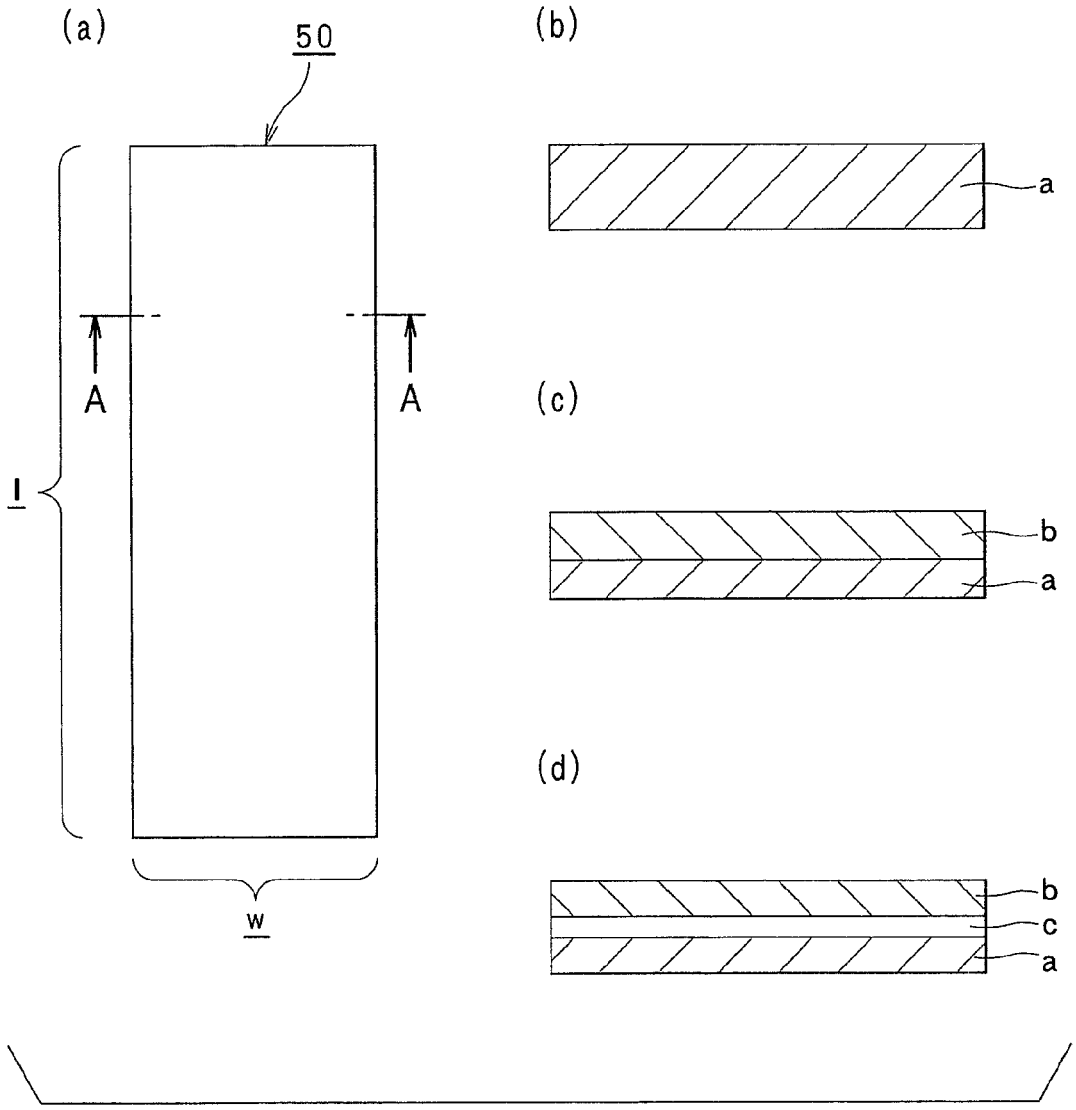
FIG. 1 is an enlarged diagram illustrating the construction of a tape-shaped sheet material that, in use, is applied to a spout port part in a bag with a pouring spout in a first aspect of the present invention, wherein FIG. 1 (*a*) is a plain view of a tape-shaped sheet material, and FIGS. 1 (*b*), (*c*) and (*d*) are typical cross-sectional views taken on line A-A of FIG. 1 (*a*).

A tape-shaped sheet material 50 shown in FIG. 1 (*a*) is one prepared by cutting a wound continuous tape shaped sheet material having a predetermined width w into a predetermined length l and is in a state immediately before the application to the inner surface of a laminated film in a spout port part.

The tape shaped sheet material 50 may take layer constructions as shown, for example, in FIGS. 1 (*b*), 1 (*c*) and 1 (*d*). Specifically, FIG. 1 (*b*) shows an embodiment where the tape shaped sheet material 50 has a single layer construction of a thermally adhesive resin layer a having thermal adhesion to a sealant layer provided on the inner surface of the laminated film in the bag.

FIG. 1 (*c*) shows an embodiment where the tape shaped sheet material 50 is formed of a laminate having a two-layer structure of a thermally adhesive resin layer a and a layer b formed of either a resin having a melting point above the resin constituting the thermally adhesive resin layer a or other thermoformable material.

FIG. 1 (*d*) shows an embodiment where the tape shaped sheet material 50 has a three-layer structure of a thermally adhesive resin layer a, a layer b formed of either a resin having a melting point above the resin constituting the thermally adhesive resin layer a or other thermoformable material and an adhesive layer c provided between the thermally adhesive resin layer a and the layer b.

In the construction of the tape shaped sheet material 50 shown in FIG. 1 (*a*), the width w of the sheet material 50 may be properly determined so that the width w is slightly smaller than the width of the spout port part in the bag, and the length l may be one extended from a position slightly inward from the opening position on the front end side of the spout port part to a part near the base of the spout port part. More preferably, the length l is one extended to a position which is further extended by about 10 to 30 mm from the base of the spout port part toward the center part of the bag.

In the layer construction of the tape shaped sheet material 50 shown in FIGS. 1 (*b*), 1 (*c*) and 1 (*d*), the surface of the thermally adhesive resin layer a having thermal adhesion to the sealant layer on the inner surface of the laminated film in the bag is disposed so as to face and is applied to the inner surface of the laminated film in the spout port part, and the assembly is thermoformed to weld the thermally adhesive resin layer a and the laminated film in the spout port part to each other. The resin used in the thermally adhesive resin layer a may be properly selected, depending upon the resin in the sealant layer on the inner surface of the laminated film in the bag, from polyolefin resins, for example, low-density polyethylenes, linear low-density polyethylenes, medium-density polyethylenes, high-density polyethylenes, and, further, ethylene copolymers such as ethylene-α-olefin copolymers, ethylene-vinyl acetate copolymers (EVAs), ethylene-acrylic acid copolymers (EAAs), ethylene-methacrylic acid copolymers (EMAA), ethylene-acrylic ester copolymers, ethylene-methacrylic ester copolymers and ionomers, polypropylenes, propylene copolymers, or blend resins thereof.

As in the tape shaped sheet material 50 shown in FIGS. 1 (*c*) and (*d*), when the sheet material 50 is formed of a laminate of two or more layers while the layer on the opposite side of the thermally adhesive resin layer a is a layer b formed of either a resin having a melting point above the resin in the thermally adhesive resin layer a or other thermoformable material, the resin having a melting point above the resin in the thermally adhesive resin layer a is not particularly limited so far as the resin has a melting point above the resin selected for the thermally adhesive resin layer a. These resins may be properly selected from various polyolefin resins described above as resins usable in the thermally adhesive resin layer a, and, further, polyesters such as polyethylene terephthalate, polybutylene terephthalate, and polyethylene naphthalate, polyamides such as various nylons, 4-methylpentene-1 resins, polycarbonates and the like may also be used.

Examples of other thermoformable materials described above include metal foils such as aluminum foils.

The use of the resin having a melting point above the heat-sensitive adhesive resin or other thermoformable material in the layer on the opposite side of the thermally adhesive resin layer a can realize heat bonding and thermoforming/welding at a higher temperature in the application of the tape shaped sheet material to the inner surface of the spout port part in the bag by spot sealing or the like followed by thermoforming of the sheet material and the outer laminated film into an outward bulged gutter shape in which the tape shaped sheet material and the laminated film have been welded to each other. As a result, the processing speed can be further enhanced, and the productivity can be further improved.

When the sheet material 50 is formed of a laminate having a three-layer structure of a thermally adhesive resin layer a, a layer b formed of either a resin having a melting point above the resin constituting the thermally adhesive resin layer a or other thermoformable material, and an adhesive layer c provided between the thermally adhesive resin layer a and the layer b, as in the tape shaped sheet material 50 shown in FIG. 1 (*d*), the adhesive layer c as the intermediate layer may be selected according to the production process of the laminate. For example, in addition to one-component or two-component curing-type adhesives for dry lamination, polyethylene-type or polypropylene-type adhesive resins for extrusion lamination may be used.

When the tape shaped sheet material is formed of a single resin and is applied to the spout port part in the bag by thermal bonding, a resin having thermal adhesion to the bag in its application face (generally a sealant layer) is selected depending upon the material of the application face, and examples thereof include low-density polyethylenes, linear low-density polyethylenes, medium-density polyethylenes, high-density polyethylenes, polypropylenes, and, further, ethylene copolymers and propylene copolymers.

When medium-density polyethylenes, high-density polyethylenes, polypropylenes, and propylene copolymers among these polymers are used, by virtue of their excellent heat resistance, bags can also be used in applications where, after hermetical sealing of contents in the bag with a pouring spout, retorting is carried out.

In the formation of a tape shaped base material having a two-layer structure as a specific example of the formation of a tape shaped base material having a multilayer structure of two or more, for example, a construction may be adopted in which the base material on its side to be thermally bonded to the spout port part in the bag is formed of a low-density polyethylene layer while the other side is formed of a medium-density polyethylene layer. On the other hand, when a tape shaped base material having a three-layer structure is formed, for example, a construction may be adopted in which the base material on its side to be thermally bonded to the spout port part in the bag is formed of a low-density polyethylene layer, the base material on its side remote from the low-density polyethylene layer is formed of a polypropylene layer, and an intermediate layer between the low-density polyethylene layer and the polypropylene layer is formed of a layer of an adhesive resin such as a propylene copolymer for improving the adhesion between the low-density polyethylene layer and the polypropylene layer.

The thickness of the tape shaped sheet material 50 is preferably 0.15 to 1 mm, more preferably 0.2 to 0.5 mm. When the thickness of the sheet material 50 is less than 0.15 mm, the effect of improving the rigidity and shape retention of the thermoformed part in the thermoforming of the sheet material 50 and the outer laminated film into a gutter shape in which the assembly is bulged outward is reduced. On the other hand, when the thickness of the sheet material 50 exceeds 1 mm, since the effect of improving the rigidity and shape retention of the thermoforming part is already in a satisfactory state, there is no need to provide the sheet material having this large thickness. In this case, rather, a lot of time is necessary for thermoforming, and the productivity is lowered.

When the tape shaped sheet material has been colored, a method may be adopted in which, after the tape shaped sheet material is applied to the inner surface of the spout port part in the bag, for example, the presence or absence of the applied sheet material or positional failure is detected by optical means to automatically remove defectives. Therefore, the quality control of the sheet material in the bag with a pouring spout can be carried out more reliably.

When the tape shaped sheet material 50 is colored for quality control purposes, an example of a simple coloring method is to incorporate a colorant into the resin in sheet forming of the sheet material 50. In particular, when the sheet material 50 is formed of a laminate of two or more layers, coloring of any one of the layers suffices for the contemplated effect. Therefore, an increase in cost can be suppressed as compared with the case where all the layers are colored.

Other methods such as printing may also be used for coloring. For example, in a construction as shown in FIG. 1 (*d*), when the thermally adhesive resin layer a and the layer b formed of either a resin having a melting point above the resin constituting the thermally adhesive resin layer a or other thermoformable material are stacked onto top of each other by dry lamination or extrusion lamination, a method may be adopted in which any one of the lamination faces is colored, for example, by printing.

The color for coloring is not particularly limited so far as the color can be optically detected. For example, blue and red are suitable.

The above tape shaped sheet material 50 may be produced by any method without particular limitation, and examples of methods usable herein include a single layer or multilayer extrusion method, a method in which a thermally adhesive layer a is extrusion coated and stacked onto a layer b formed of either a resin having a melting point above the resin constituting the thermally adhesive resin layer a or other thermoformable material, and a method in which a thermally adhesive resin layer a and a layer b formed of either a resin having a melting point above the resin constituting the thermally adhesive resin layer a or other thermoformable material are stacked on top of each other by extrusion lamination or dry lamination.

In particular, when the tape shaped sheet material 50 is produced by the single layer or multilayer extrusion method, a tape shaped sheet material 50 having a predetermined width w is formed in a line and is wound. Alternatively, a method may also be adopted in which the tape shaped sheet material is prepared in a roll form having a large width of multiple rows as a whole and is then cut by a slitter into individual rolls having a predetermined width w. The latter method is superior in efficiency and productivity.

In the formation of a tape shaped sheet material having a two-layer structure as a specific example of the formation of a tape shaped sheet material 50 having a laminate of two or more, for example, a construction may be adopted in which the thermally adhesive resin layer a on the side to be thermally bonded to the spout port part in the bag is formed of low-density polyethylene while the layer (b) on the opposite side of the thermally adhesive resin layer a is formed of a medium-density polyethylene layer. On the other hand, when a tape shaped sheet material having a three-layer structure is formed, for example, a multilayer coextrusion method may be adopted in which the thermally adhesive resin layer a on the side to be thermally bonded to the spout port part in the bag is formed of low-density polyethylene, the layer (b) on the opposite side of the thermally adhesive resin layer a is formed of polypropylene, and an adhesive layer c as an intermediate layer between the low-density polyethylene layer a and the polypropylene layer b is formed of a layer of an adhesive resin such as a propylene copolymer for improving the adhesion between the low-density polyethylene layer a and the polypropylene layer b.

Further, in the present invention, the tape shaped sheet material 50 may be first applied to the inner surface of the laminated film in the spout port part in the bag by applying the tape shaped sheet material 50 in a spot form with the aid of an adhesive such as a hot melt adhesive. Since, however, the tape shaped sheet material 50 and the laminated film are then thermoformed into a gutter shape in which the tape shaped sheet material 50 and the laminated film have been welded to each other, the application by thermal bonding methods such as spot sealing is more preferred because of low production cost and excellent productivity.

Figure 2:
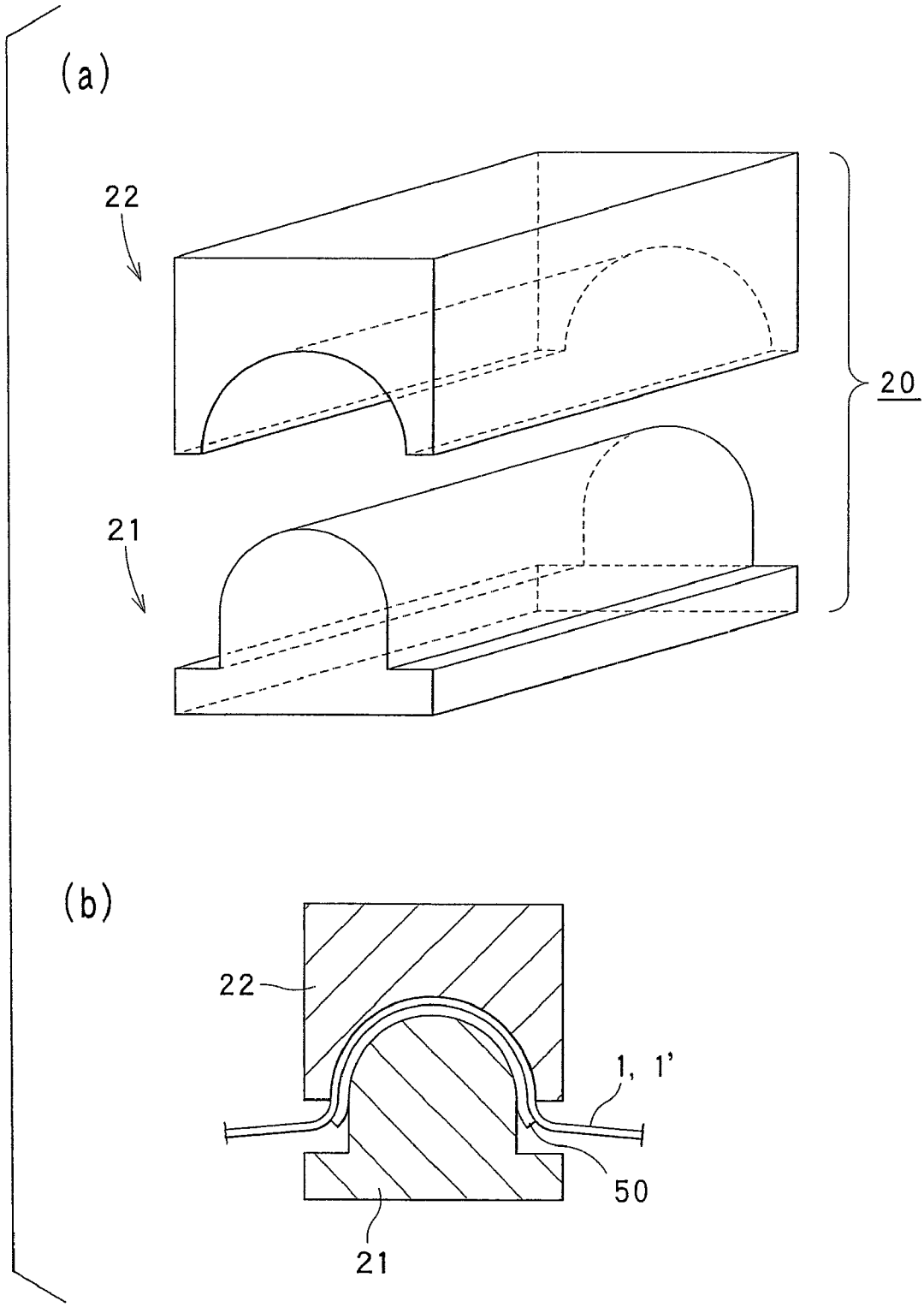
FIG. 2 is an example of a forming die that, in the production of a bag with a pouring spout in the first aspect of the present invention, is used in the thermoforming of a tape-shaped material and a laminated film into an outward bulged gutter shape in which the tape-shaped material and the laminated film have been welded to each other, wherein FIG. 2 (*a*) is a perspective diagram showing a state that a male die and a female die in a forming die are separated from each other, and FIG. 2 (*b*) a cross-sectional view of the forming die showing a state that a tape-shaped sheet material and a laminated film are inserted into between a male die and a female die and the assembly is subjected to thermopressing.

A forming die 20 shown in FIG. 2 (*a*) is used in thermopressing and comprises a male die 21 comprising a horizontal semicylindrical forming convex part and a female die 22 comprising a horizontal semicylindrical forming concave part. A tape shaped sheet material 50 having a construction as shown in FIGS. 1 (*a*) to 1 (*d*) is disposed onto the laminated film 1 or 1' in the spout port part of the bag so that the inner surface of the laminated film 1 or 1' faces the surface of the thermally adhesive resin layer a in the tape shaped sheet material 50, followed by spot sealing to apply the tape shaped sheet material 50 to the laminated film 1 or 1'. The assembly to be thermoformed, which has been preheated, is introduced into between the male die 21 and the female die 22 and is heated and pressed by the male die 21 and the female die 22, whereby, as shown in FIG. 2 (*b*), the assembly is thermoformed into a gutter shape in which the center part of the tape shaped sheet material 50 is bulged in a semicylindrical form outward along the direction of flow of the tape shaped material 50 and, at the same time, the sheet material 50 and the laminated film 1 or 1' are welded to each other.

The shape of the thermopressing part in the male die 21 and the female die 22 is not limited to the horizontal semicyclindrical forming convex part and the horizontal semicylindrical forming concave part as shown in the drawing so far as the shape is such that thermoforming into an outward bulged gutter shape is possible. Examples of such shapes include those shown in FIG. 3, that is, shapes which can realize forming into products having a sectional shape of a trapezoid, a triangle, a semicircle having wavy concaves and convexes on its surface or the like.

Figure 3:
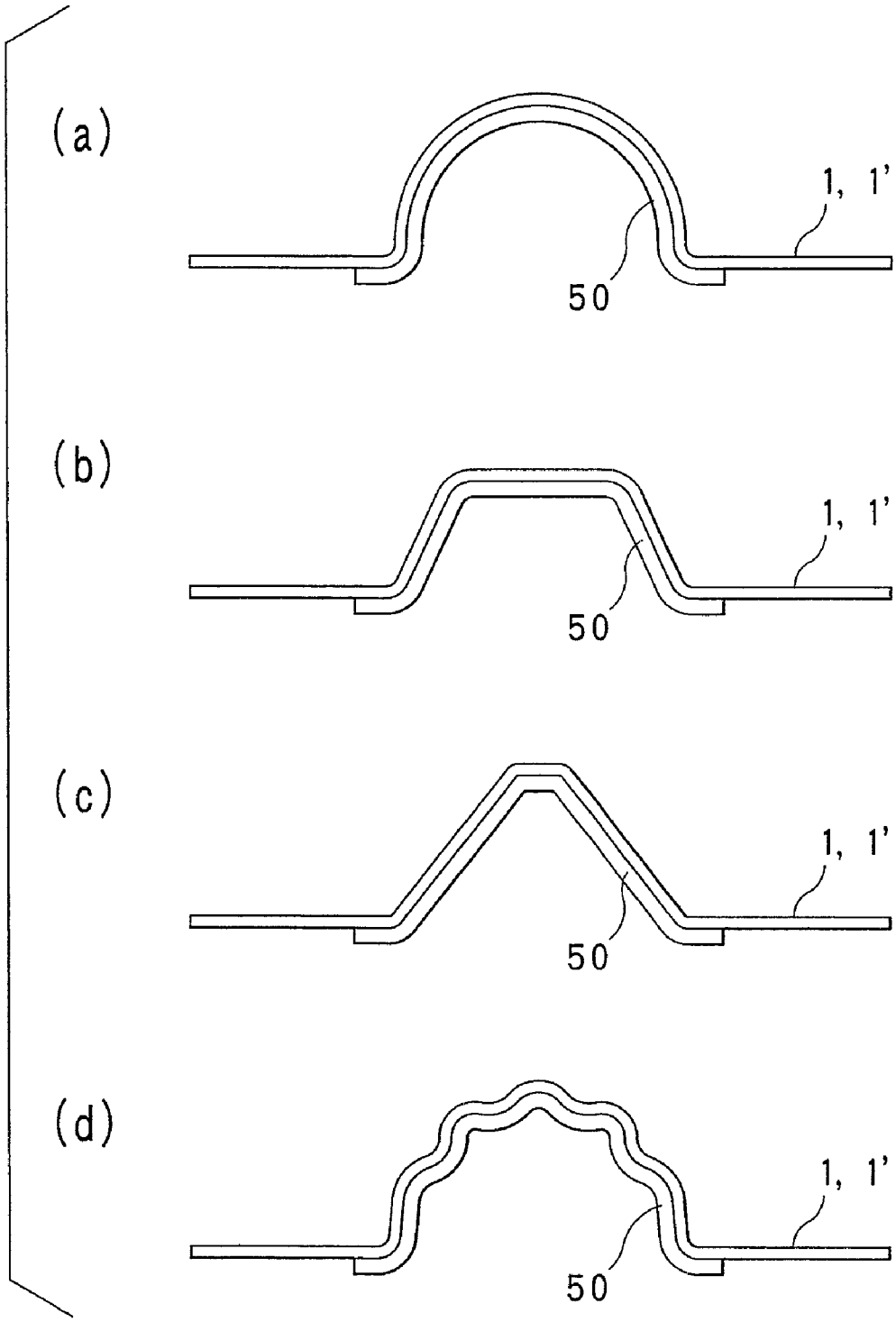
FIGS. 3 (*a*) to (*d*) are cross-sectional views showing one embodiment of a gutter-like bulging shape in a bag with a pouring spout wherein a laminated film and a tape shaped sheet material applied to the laminated film have been thermoformed into a gutter form bulged in the outward direction of the bag in which the laminated film and the tape shaped sheet material have been welded to each other.

FIG. 3 (*a*) shows an assembly which has been formed into a gutter shape having a semicircular section, FIG. 3 (*b*) an assembly which has been formed into a gutter shape having a trapezoidal section, FIG. 3 (*c*) an assembly which has been formed into a gutter shape having a triangular section, and FIG. 3 (*d*) an assembly which has been formed into a gutter shape having a semicircular section having wavy concaves and convexes on its surface. Any of these shapes may be adopted. Further, modified shapes thereof may also be adopted.

As shown in FIGS. 1 (*b*), 1 (*c*) and 1 (*d*), the tape shaped sheet material 50 may have a single layer structure, or alternatively may have a laminated construction of two layers, three layers or the like.

Figure 4:
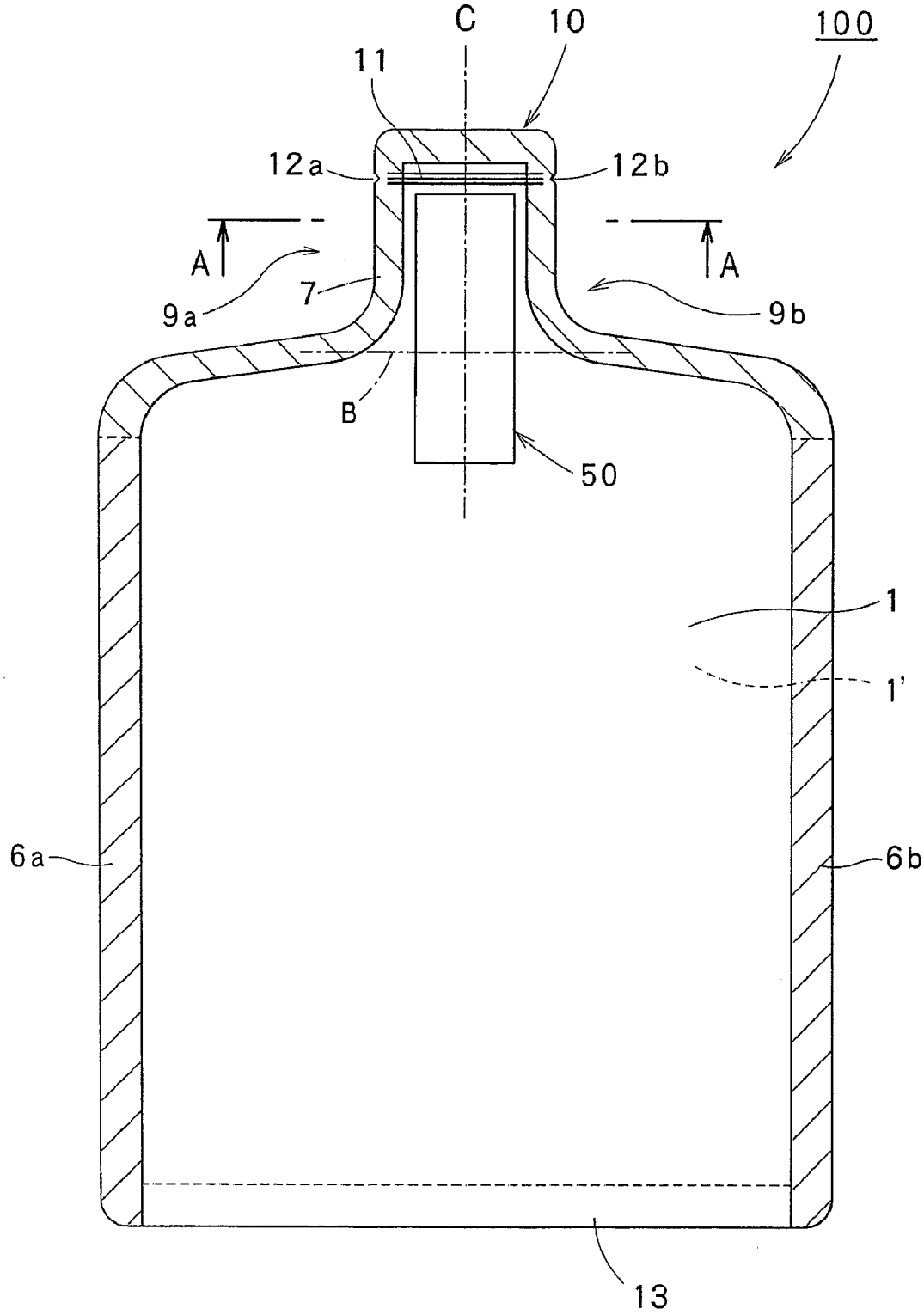
FIG. 4 is a typical plan view showing the construction of an embodiment of the bag with a pouring spout according to the first aspect of the present invention.

FIG. 4 shows a bag 100 with a spout port part. This bag 100 with a spout port part has been prepared by utilizing a four sided seal-type bag. The edge parts of both sides of the front and rear wall surface films (laminated films) 1, 1' are heat sealed by side seal parts 6*a*, 6*b*, and a spout port part 10 having a narrow width is formed on the center part in the upper part by heat sealing the periphery of the spout port part 10 by a spout port part seal part 7. Notch parts 9*a*, 9*b* are provided on both respective sides of the spout port part 10, and, thus, the spout port part 10 is provided in an upward protruded shape. Further, a tape shaped sheet material 50 is previously applied onto the inner surface of a laminated film 1 of at least one side (front side) of the spout port part 10 along a center line C in the spout port part 10 by a length extended from a position slightly inward from the opening position on the front end side of the spout port part to a position which is about 15 mm toward the center part of the bag 100 from a line B indicating the base of the spout port part. The tape shaped sheet material 50, together with the outer laminated film 1, is thermoformed into an outward bulged gutter shape in which the tape shaped sheet material 50 and the outer laminated film 1 have been welded to each other. Further, the opening position on the front end side of the spout port part 10 is provided with easy opening means, that is, a halfcut line 11 and notches 12*a*, 12*b* on both ends of the halfcut line 11. Easy opening means include halfcut lines and, further, notches and indications indicating opening, for example, perforated lines, characters, and marks formed by printing. These means may be used solely. The use of a combination of, for example, a printed perforated line, a notch, and a halfcut line is further preferred.

The lower edge part of the bag 100 is heat sealed by a lower seal part 13. This part is used as a filling port for contents. Therefore, before filling of the contents, this part is an unsealed opening part, and, after the filling of the contents, the opening part is heat sealed.

As shown in FIGS. 1 (*b*), 1 (*c*) and 1 (*d*), the tape shaped sheet material 50 may have a single layer structure, or alternatively may have a laminated construction of two layers, three layers or the like.

The halfcut line 11 is shown as three parallel halfcut lines but is not particularly limited to this only. Specifically, the halfcut line 11 may be constituted by a single or two halfcut lines. Further, measures may be taken against the deviation of a tear-off line from the central halfcut line at the time of opening. Such measures may be in any form, and examples thereof include one wherein each one to each three halfcut lines may be provided on both sides of the central halfcut line, that is, a plurality of halfcut lines may be provided parallel to the central halfcut line or provided so as to converge to the central halfcut line, or one wherein a plurality of parallel halfcut lines are provided in combination with an oblique halfcut line which obliquely crosses the parallel halfcut lines.

The halfcut line is preferably provided by a laser beam irradiation method, because the halfcut line can be provided in a stable depth even on an irregular surface and, at the same time, a plurality of halfcut lines can easily be provided in any desired form.

Figure 5:
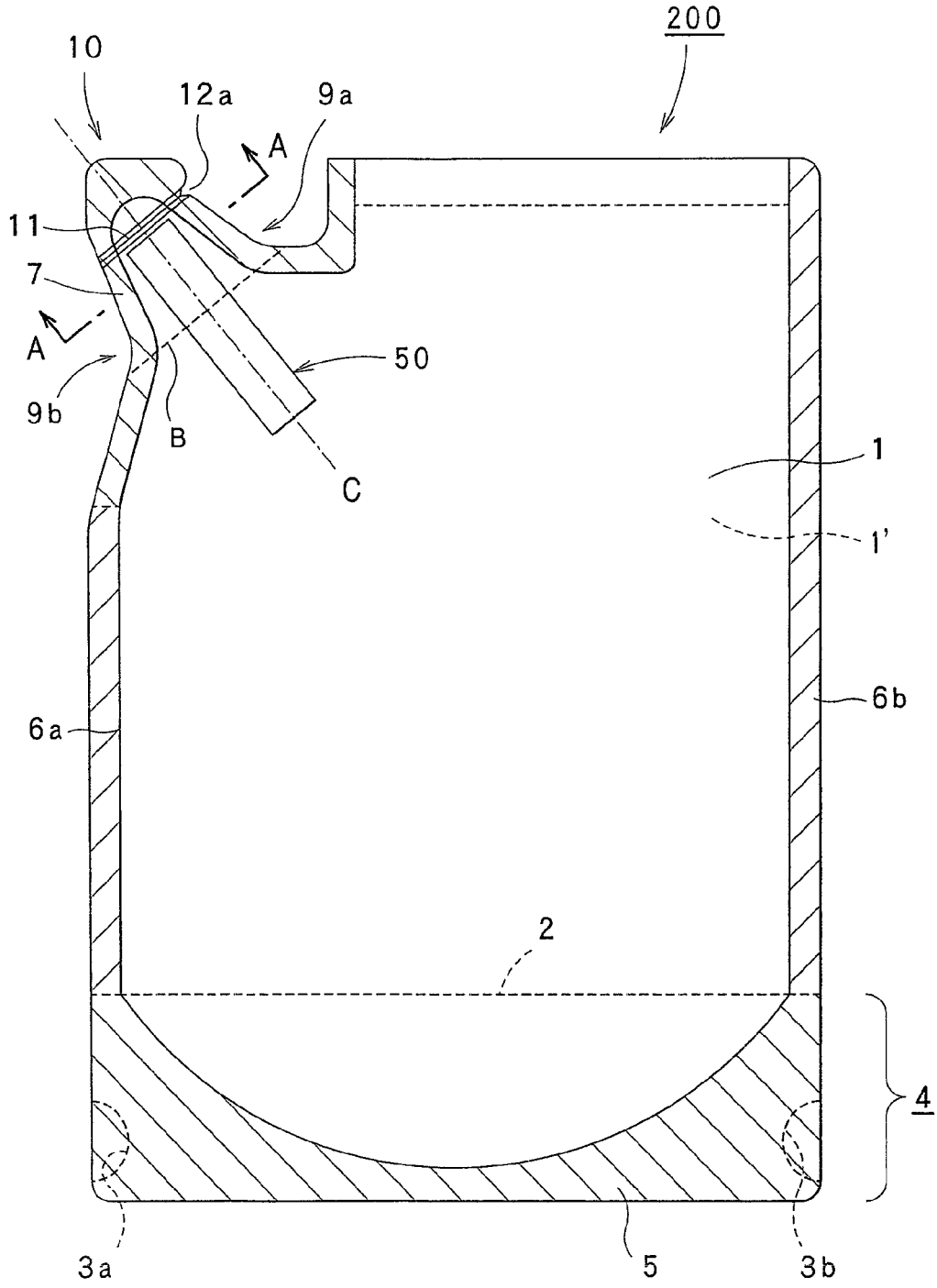
FIG. 5 is a typical plan view showing the construction of another embodiment of the bag with a pouring spout according to the first aspect of the present invention.

FIG. 5 shows a bag 200 with a spout port part prepared by utilizing a standing pouch-type bag. The standing pouch per se is already well known. The bottom of the bag is formed so as to have a gusset part in which a bottom film is inserted in an inward folded state into between front and rear wall surface films on their lower parts. A bottom film notch part such as a semicircular or other shape is provided near the lower end of both sides of the inward folded bottom film. The gusset part is formed by heat sealing by a bottom seal part of a ship bottom-shaped seal pattern in which the inner side is a concave form defined, for example, by a line which is curved from both sides toward the central part. The body part of the bag is formed by heat sealing of the edge part of both sides of the front and rear wall surface films by a side seal part having a predetermined width.

The standing pouch form can impart excellent self-standing properties to the bag. As a result, the bag can easily be handled. Further, the appearance is excellent, and the contents can be packed compactly. Furthermore, since the spout port part is provided at one corner part in the upper part of the bag, the contents can easily be spouted. Further, in this case, in the upper part of the bag, the spout port part free part can be used as a filling port for contents. Therefore, the filling port can have a relatively large width, and the contents can easily be filled into the bag.

In the case of a standing pouch form, the bottom of the bag is formed so as to have a gusset part 4 in which a bottom film is inserted in an inward folded state into between front and rear wall surface films (laminated film) 1, 1' on their lower parts to a bottom film folded part 2. In this case, semicircular bottom film notch parts 3*a*, 3*b* are provided near the lower end of both sides of the inward folded bottom film. The gusset part 4 is formed by heat sealing by a ship bottom-shaped bottom seal part 5 in which the inner side is a concave form defined by a line which is curved from both sides toward the central part. The body part of the bag is formed by heat sealing of the edge part of both sides of the front and rear wall surface films (laminated films) 1, 1' by side seal parts 6*a*, 6*b*. A spout port part 10 having a narrow width, which has a peripheral part heat sealed by a spout port part seal part 7, has a tapered shape, and faces in an oblique outward upward direction, is provided in a protruded form at one corner part (in the drawing, a left corner part) in the upper part of the bag 200 by providing notches 9*a*, 9*b* on both sides of the spout port part.

Also in this case, a tape shaped sheet material 50 is previously applied onto the inner surface of a laminated film 1 of at least one side (front side) of the spout port part 10 along the direction of the spout port part 10 by a length extended from a position slightly inward from the opening position on the front end side of the spout port part to a position which is about 10 to 15 mm toward the center part of the bag 100 from the base of the spout port part. The tape shaped sheet material 50, together with the outer laminated film 1, is thermoformed into an outward bulged gutter shape in which the tape shaped sheet material 50 and the outer laminated film 1 have been welded to each other. Further, the opening position on the front end side of the spout port part 10 is provided with easy opening means, that is, a halfcut line 11 and a notch 12*a* on the upper end of the halfcut line 11.

In the upper part of the bag 200, the spout port part 10-free part is heat sealed by an upper seal part 8. This part is used as a filling port for contents. Therefore, before filling of the contents, this part is an unsealed opening part, and, after the filling of the contents, the opening part is heat sealed.

Also in this case, as shown in FIGS. 1 (*b*), 1 (*c*) and 1 (*d*), the tape shaped sheet material 50 may have a single layer structure, or alternatively may have a laminated construction of two layers, three layers or the like.

Further, as with FIG. 4, the halfcut line 11 is indicated by three parallel halfcut lines. As described above, however, the halfcut line 11 is not particularly limited to this only. Specifically, the halfcut line 11 may be constituted by a single or two halfcut lines. Further, the halfcut line 11 may be such that each one to each three halfcut lines are be provided on both sides of the central halfcut line, that is, a plurality of halfcut lines are provided parallel to the central halfcut line or provided so as to converge to the central halfcut line, or may be such that a plurality of parallel halfcut lines are provided in combination with an oblique halfcut line which obliquely crosses the parallel halfcut lines.

Figure 6:
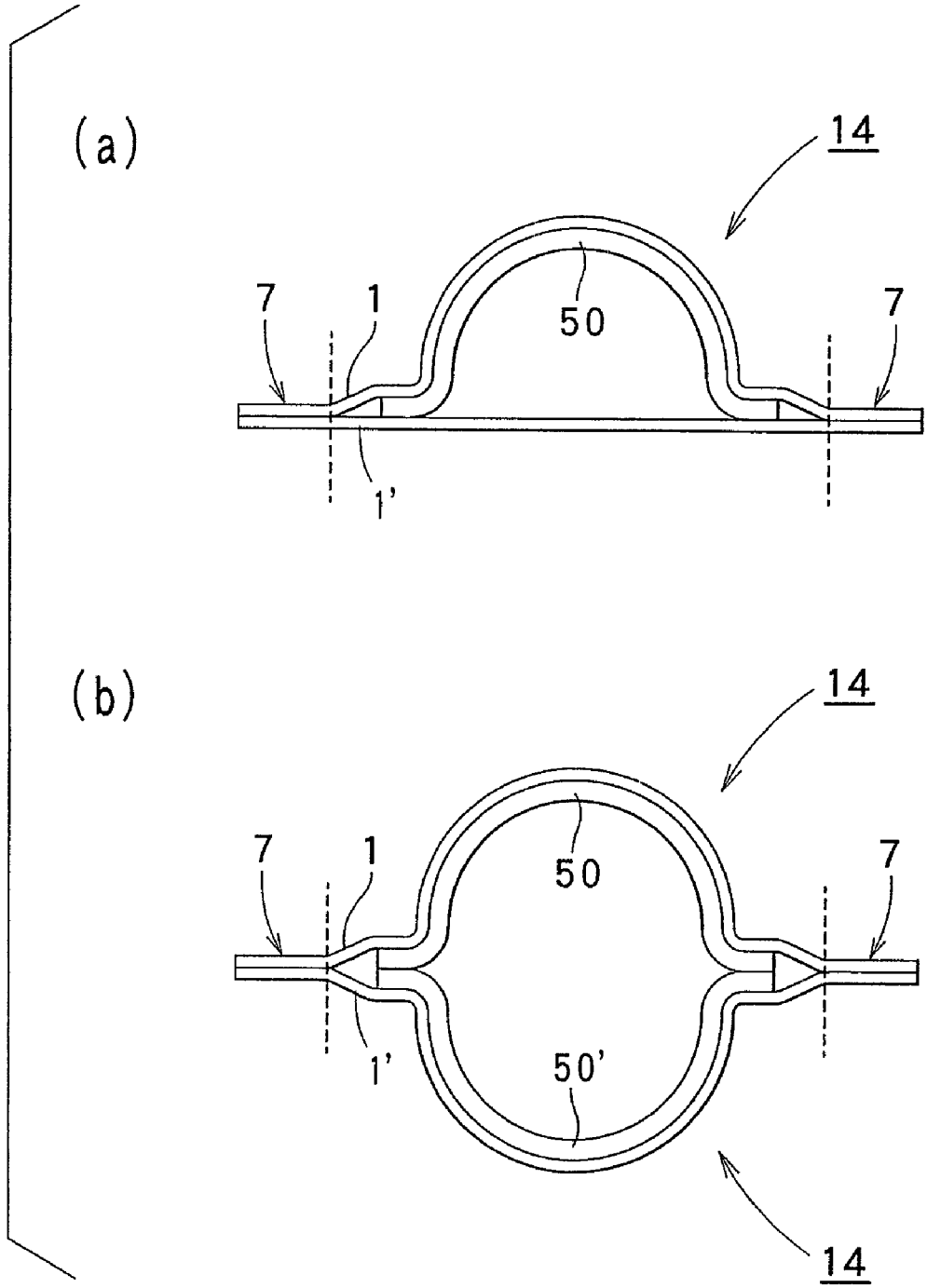
FIG. 6 is a cross-sectional view taken on line A-A of the spout port part in the bag with a pouring spout shown in FIGS. 4 and 5, wherein FIG. 6 (*a*) is a cross-sectional view showing one embodiment of a bulging shape formed by applying a tape shaped material onto the inner surface of a laminated film only on one side (front side) of a spout port part and thermoforming the assembly, and FIG. 6 (*b*) a cross-sectional view showing one embodiment of a bulging shape formed by applying a tape shaped material onto the inner surface of a laminated film on both sides of the spout port part and thermoforming the assembly.

FIG. 6 (*a*) is a cross-sectional view showing one embodiment of a bulging shape formed by applying a tape shaped sheet material onto the inner surface of a laminated film only on one side (front side) of a spout port part and thermoforming the assembly, wherein the inside of the spout port part 10 is in a semicylindrically broadened form.

FIG. 6 (*b*) is a cross-sectional view showing one embodiment of a bulging shape formed by applying a tape shaped sheet material onto the inner surface of a laminated film on both sides of the spout port part and thermoforming the assembly, wherein the inside of the spout port part 10 is in a cylindrically significantly broadened form.

The shape of cylindrical broadening of the spout port part 10 shown in FIGS. 6 (*a*) and 6 (*b*) can easily be varied to those as shown in FIGS. 3 (*a*) to 3 (*d*) by varying the shape of thermoforming die 20 in the thermoforming of the tape-shaped sheet material 50 and the outer laminated films 1, 1' into a gutter shape.

Regarding the shape of bulging of the spout port part 10, when the tape shaped sheet material 50 is applied to the inner surface of the laminated films 1, 1' on the respective front and rear surfaces of the spout port part 10 followed by thermoforming into a gutter shape, the front and rear assemblies can be thermoformed into an identical shape to provide a cylindrical form. Alternatively, for example, a cylindrical form may be provided by combining different shapes of FIGS. 3 (*a*) to 3 (*d*).

Figure 7:
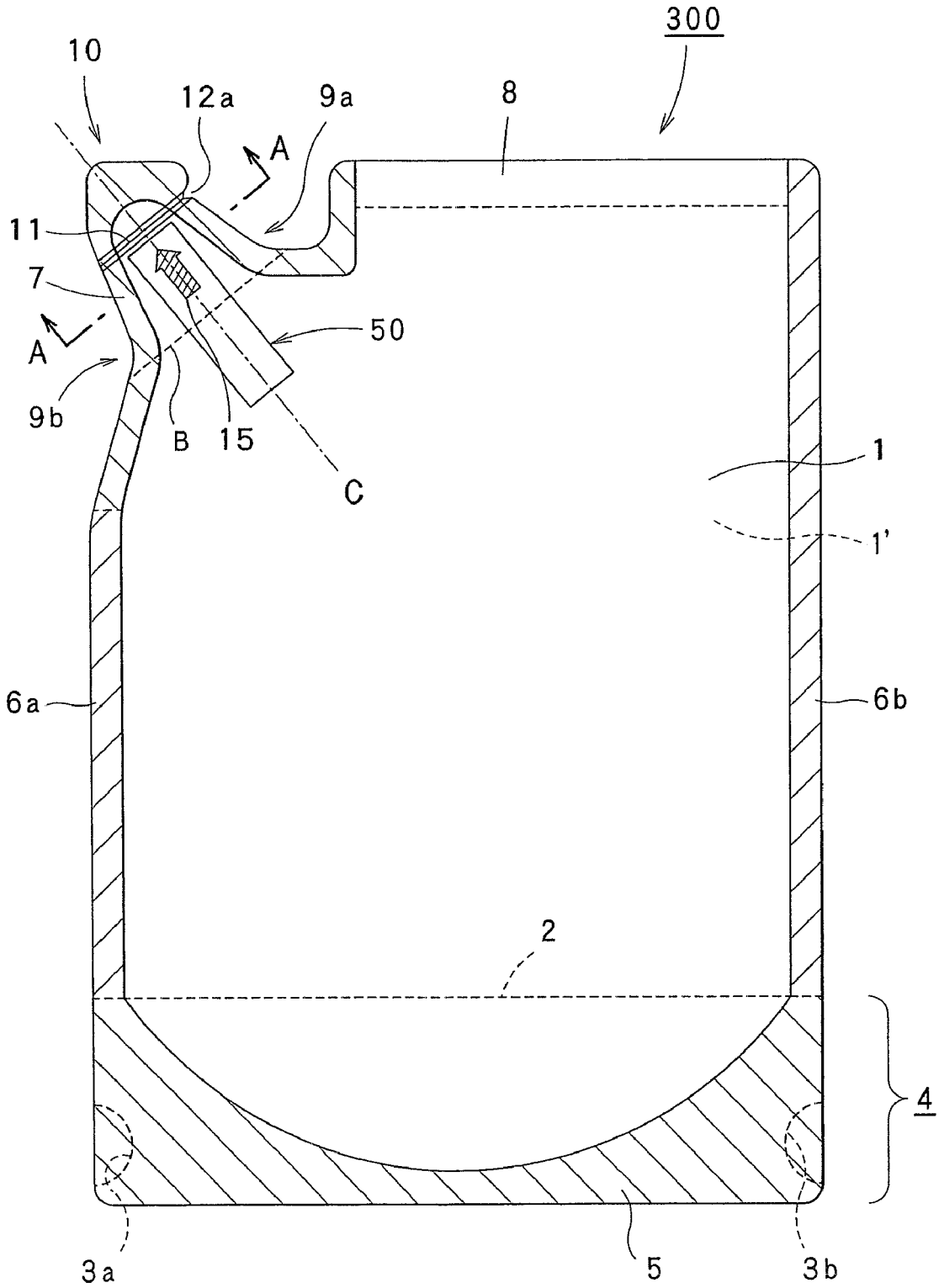
FIG. 7 is a typical plan view showing the construction of still another embodiment of the bag with a pouring spout according to the first aspect of the present invention.

FIG. 7 shows a bag 300 with a spout port part. The bag 300 with a spout port part shown in FIG. 7 has the same construction as the bag 200 with a spout port part shown in FIG. 5, except that tape shaped sheet materials 50, 50' are applied to the inner surface of laminated films 1, 1' on both respective sides of the spout port part 10, the assemblies on both sides are thermoformed into an outward bulged gutter shape, and an arrow-type concave-convex shape 15 is thermoformed on the surface of a gutter-shaped forming part 14 of the laminated film and the sheet material on both sides simultaneously with thermoforming into the gutter shape so that, in this case, all the layers are allowed to stand out. The provision of at least one of a pattern, a symbol, and a character in a concave-convex form on the surface of the forming part which has been thermoformed into a gutter shape, can enhance the decorativeness of the spout port part, or can further clarify, for example, identification of the contents or indications of the spouting part.

The pattern may be any desired concave-convex pattern such as a stripe or texture. Regarding the symbol or character, any symbol or character, for example, not only symbols such as arrows for indicating the spout direction of the contents, but also characters or raised letters for identifying the contents may be provided in a concave-convex form. In thermoforming the tape shaped sheet material and the laminated film disposed on the outer side of the tape shaped sheet material into a gutter shape, the concave-convex form can be thermoformed simultaneously with the thermoforming into the gutter shape by providing a concave-convex shape in at least a thermoforming female die.

Figure 8:
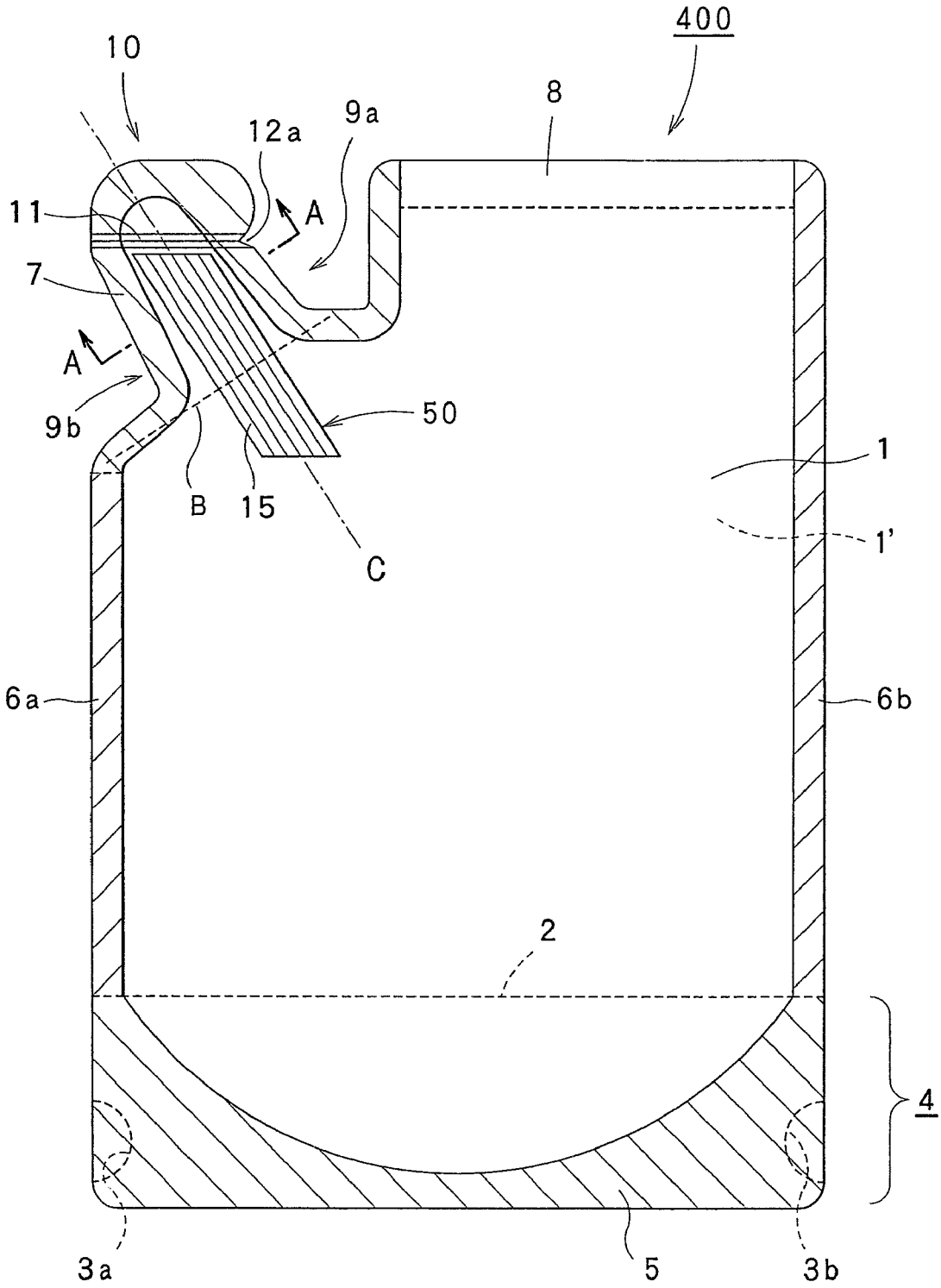
FIG. 8 is a typical plan view showing the construction of a further embodiment of the bag with a pouring spout according to the first aspect of the present invention.
Figure 9:
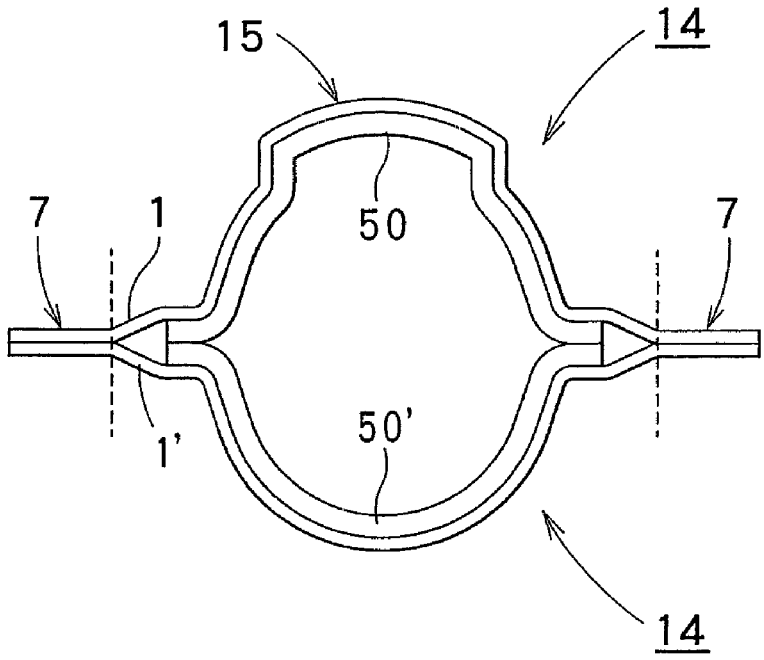
FIG. 9 is a cross-sectional view taken on line A-A of the spout port part in the bag with a pouring spout shown in FIG. 7.
Figure 10:
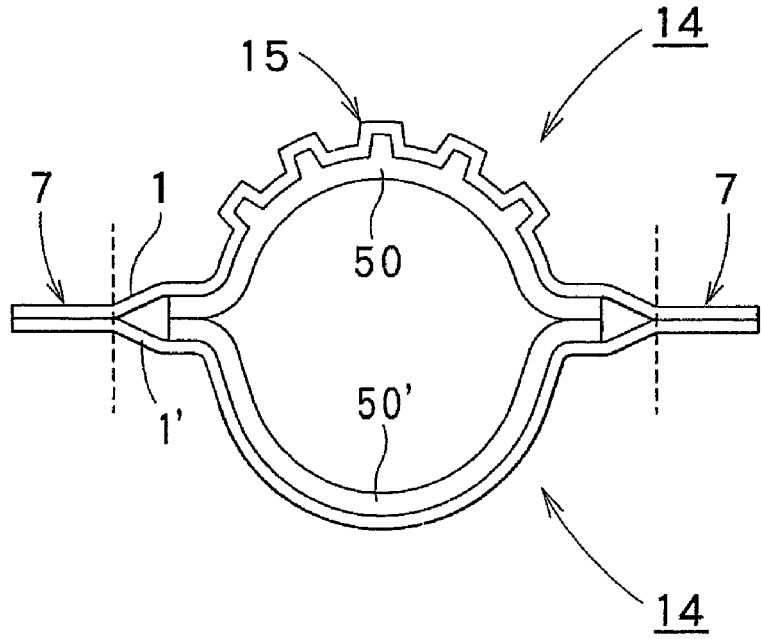
FIG. 10 is a cross-sectional view taken on line A-A of the spout port part in the bag with a pouring spout shown in FIG. 8.

FIG. 8 shows a bag 400 with a spout port part has the same construction as the bag 200 with a spout port part shown in FIG. 5, except that the direction of an opening line (in this case, a halfcut line 11) on the front end side of the spout port part 10 is changed to a horizontal direction and, further, tape shaped sheet materials 50, 50' are applied onto the inner surface of the laminated films 1,1' on both respective sides of the spout port part 10 in such a state that the ends in the longitudinal direction of the tape shaped sheet materials 50, 50' are cut horizontally so as to conform to the halfcut line 11. Striped concaves and convexes 15 (in this case, only on a part of the surface-side layers) are thermoformed onto the surface of the gutter formed part 14 of the laminated film 1 and the sheet material 50 simultaneously with the thermoforming into the gutter shape. Also in this case, the striped concaves and convexes 15 may be provided in gutter formed parts 14 on both sides. The horizontal direction referred to herein means a direction orthogonal to a perpendicular line when the bag is allowed to stand vertically.

When the opening line of the opening position in the spout port part is provided horizontally, the opening part of the opened spout port part has the same shape as a spout port in a teapot or the like. Accordingly, the spout operation of the contents can be carried out in an easier and safer manner. In the case where the bag is of a standing pouch type, a three way seal type, a four way seal type or the like and the bag is produced in a side-by-side method, since the direction of the opening line conforms to the direction of flow of the laminated film in the bag, the spout port part can be opened in a better state more easily by hand tearing along the opening line.

(2) Bag with Pouring Spout According to Second Aspect of the Invention

In the bag with a pouring spout according to the second aspect of the present invention, a convex-shaped streak is provided on at least one of edge parts on both respective sides of a tape-shaped sheet material. According to this construction, wall surface films such as laminated films on both respective sides of the spout port part in the bag can be separated from each other to prevent intimate contact of these films. Accordingly, the spout port part can easily be opened in a cylindrical form, and the rigidity of the tape shaped sheet material in the direction of flow of the contents can be enhanced, making it possible to prevent the spout port part, to which the tape shaped sheet material has been applied, in its part near the base from being clogged upon folding. The rigidity in the flow direction can be enhanced by the convex-shaped streak. On the other hand, the rigidity in the widthwise direction is so low that, when the spout port part is opened in a cylindrical form, the spout port part can easily be curved in a gutter form along the cylindrical opening part and the shape retention can be improved and, at the same time, a stable liquid flow passage can be formed to render spouting of the contents more easy.

The convex-shaped streak can be provided in any form. When the sectional form of the streak is rectangular, the width and height of the streak are suitably in the range of 1 to 2 mm and in the range of about 1 to 3 mm, respectively.

In the tape shaped sheet material, the rigidity in the flow direction is enhanced by the convex-shaped streak. Therefore, when the tape shaped sheet material is applied to the spout port part in the bag, in spouting the contents of the bag, clogging of the spout port part caused by folding of the spout port part in its part near the base of the spout port part in the course of spouting can also be prevented by applying the tape shaped sheet material by a length extended from the opening position on the front end side of the spout port part toward the inner side of the bag to a position which is about 10 to 30 mm inward from the base of the spout port part.

Figure 11:
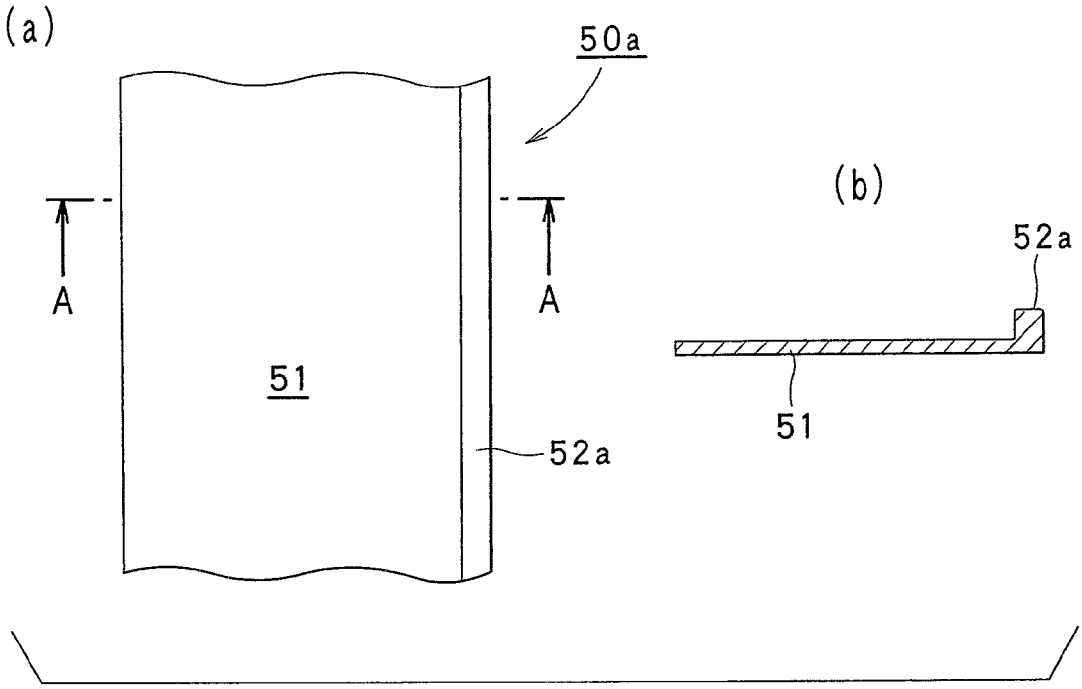
FIG. 11 is an enlarged diagram illustrating the construction of a tape-shaped sheet material that, in use, is applied to a spout port part in a bag with a pouring spout in a second aspect of the present invention, wherein FIG. 11 (*a*) is a typical plan view and FIG. 11 (*b*) a typical cross-sectional view taken on line A-A of FIG. 11 (*a*).

A tape shaped sheet material 50*a* shown in FIG. 11 has a construction that a convex-shaped streak 52*a* is provided at the edge part of one (right side in the drawing) of both side edge parts of one side of a continuous tape base material 51 having a predetermined width.

Figure 12:
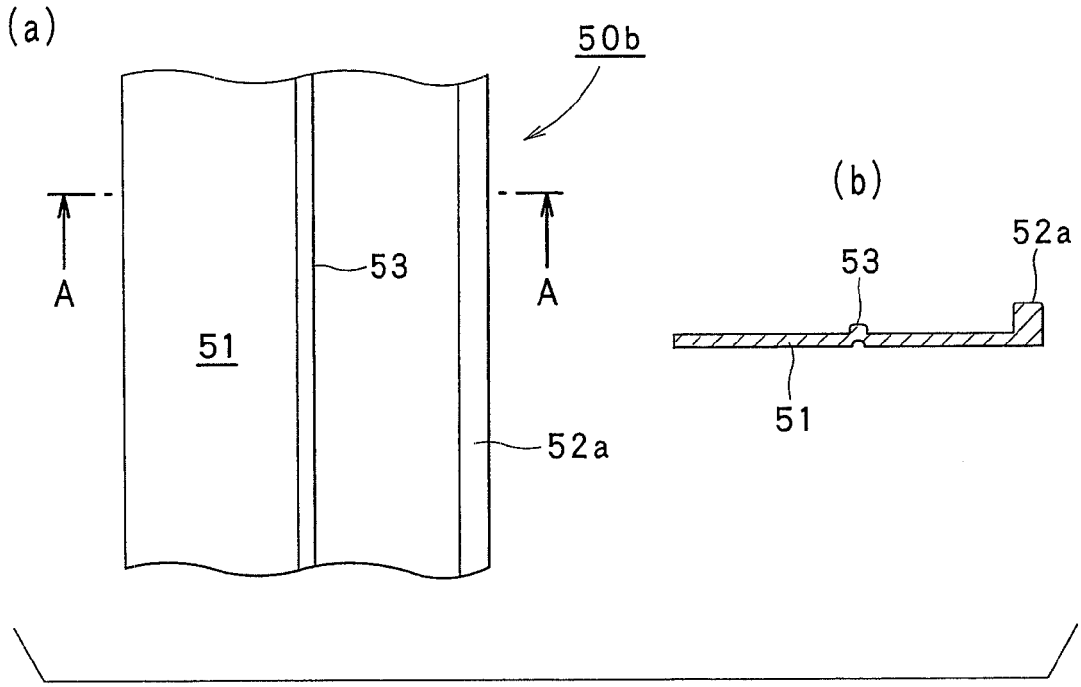
FIG. 12 is an enlarged diagram illustrating the construction of a tape-shaped sheet material that, in use, is applied to a spout port part in a bag with a pouring spout in a second aspect of the present invention, wherein FIG. 12 (*a*) is a typical plan view and FIG. 12 (*b*) a typical cross-sectional view taken on line A-A of FIG. 12 (*a*).

A tape shaped sheet material 50*b* shown in FIG. 12 has a construction that a convex-shaped streak 52*a* is provided at the edge part of one (right side in the drawing) of both side edge parts of one side of a continuous tape base material 51 having a predetermined width and, further, a folding line 53 is provided by line pressing along the flow direction at the center part in the widthwise direction of the tape base material 51. When the folding line is provided in the tape shaped sheet material by line pressing or by reducing the thickness of the sheet along the center line in the longitudinal direction of the tape shaped sheet material, in opening the spout port part at its front end-side opening position to open the spout port part in a cylindrical form, the tape shaped sheet material can be more easily folded outward by the folding line, whereby the spout port part in the bag can be more easily opened in a cylindrical form.

Figure 13:
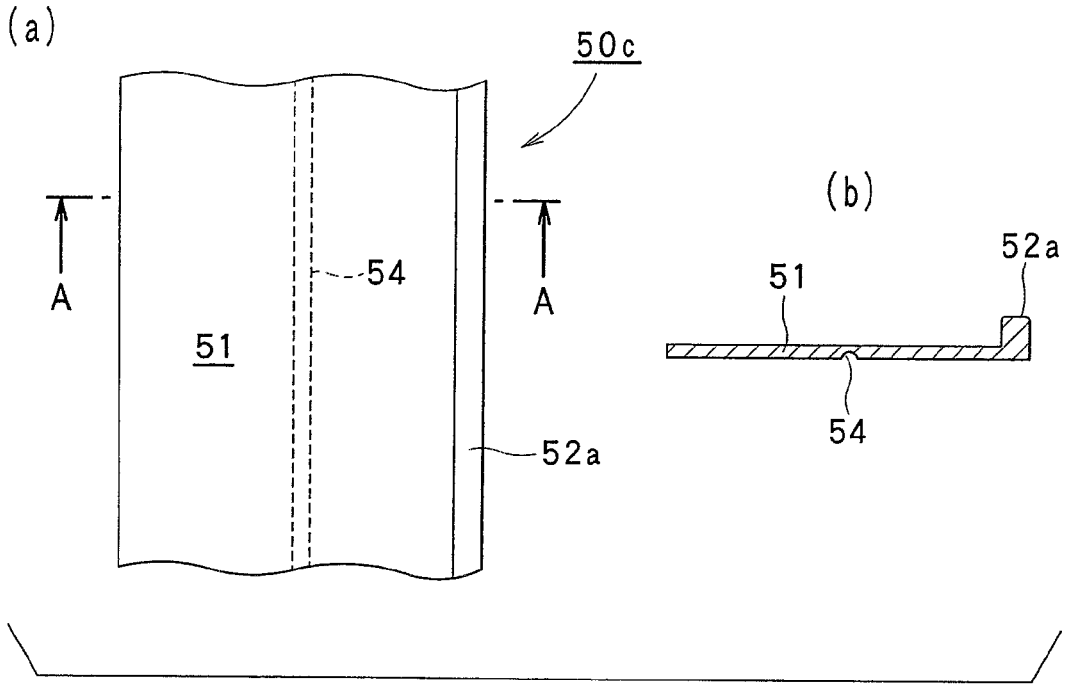
FIG. 13 is an enlarged diagram illustrating the construction of a tape-shaped sheet material that, in use, is applied to a spout port part in a bag with a pouring spout in a second aspect of the present invention, wherein FIG. 13 (*a*) is a typical plan view and FIG. 13 (*b*) a typical cross-sectional view taken on line A-A of FIG. 13 (*a*).

A tape shaped sheet material 50*c* shown in FIG. 13 has the same construction as the tape shaped sheet material 50*b* shown in FIG. 12, except that only the folding line 53 provided by line pressing along the flow direction at the center part in the widthwise direction of the tape base material 51 is changed to a folding line 54 by providing a reduced thickness part.

As shown in FIG. 13 (*b*), the folding line 54 by providing a reduced thickness part is formed by notching, in a concave form, the surface of the tape base material 51 remote from the convex-shaped streak 52*a* provided surface. The folding line 54, however, is not limited to this and may be formed by notching, in a concave form, the surface of the tape shaped sheet material on the convex-shaped streak 52*a* side.

Figure 14:
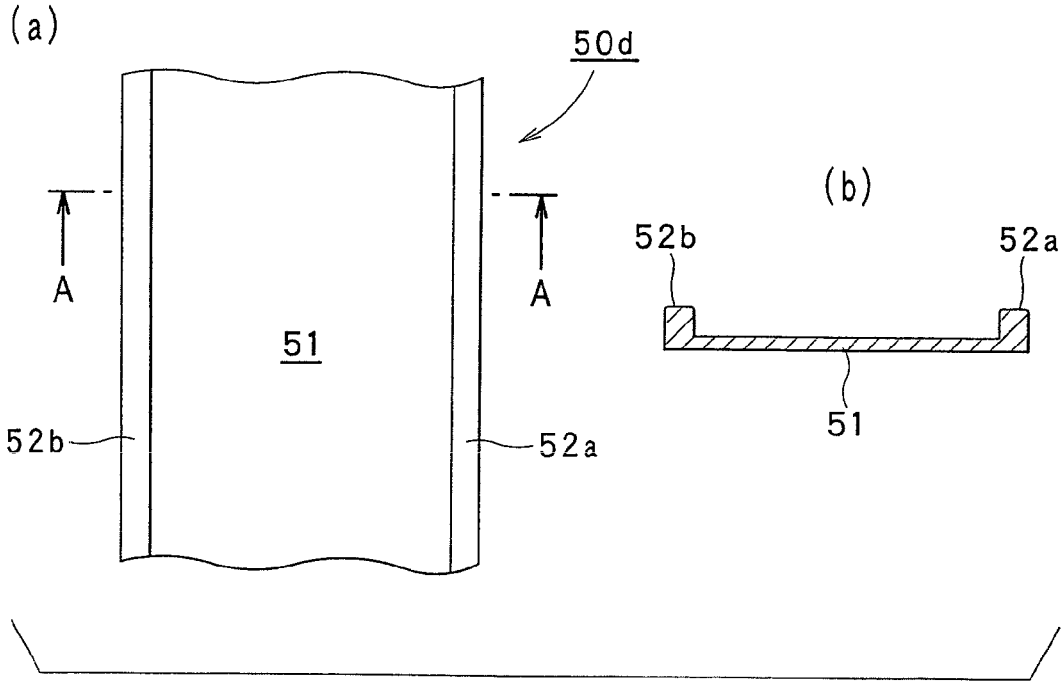
FIG. 14 is an enlarged diagram illustrating the construction of a tape-shaped sheet material that, in use, is applied to a spout port part in a bag with a pouring spout in a second aspect of the present invention, wherein FIG. 14 (*a*) is a typical plan view and FIG. 14 (*b*) a typical cross-sectional view taken on line A-A of FIG. 14 (*a*).

A tape shaped sheet material 50*d* shown in FIG. 14 comprises a continuous tape base material 51 having a predetermined width and convex-shaped streaks 52*a*, 52*b* provided at both-side edge parts on one side of the continuous tape base material 51.

Figure 15:
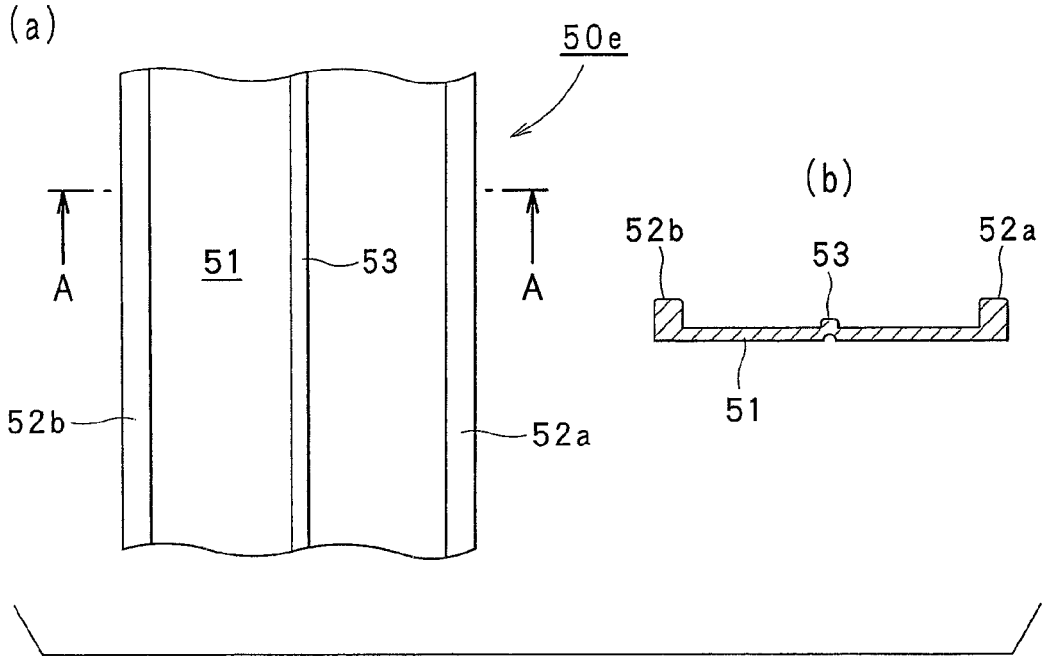
FIG. 15 is an enlarged diagram illustrating the construction of a tape-shaped sheet material that, in use, is applied to a spout port part in a bag with a pouring spout in a second aspect of the present invention, wherein FIG. 15 (*a*) is a typical plan view and FIG. 15 (*b*) a typical cross-sectional view taken on line A-A of FIG. 15 (*a*).

A tape shaped sheet material 50*e* shown in FIG. 15 comprises a continuous tape base material 51 having a predetermined width, convex-shaped streaks 52*a*, 52*b* provided at both-side edge parts on one side of the continuous tape base material 51, and a folding line 53 provided by line pressing at the center part in the widthwise direction of the tape base material 51 along the flow direction.

Figure 16:
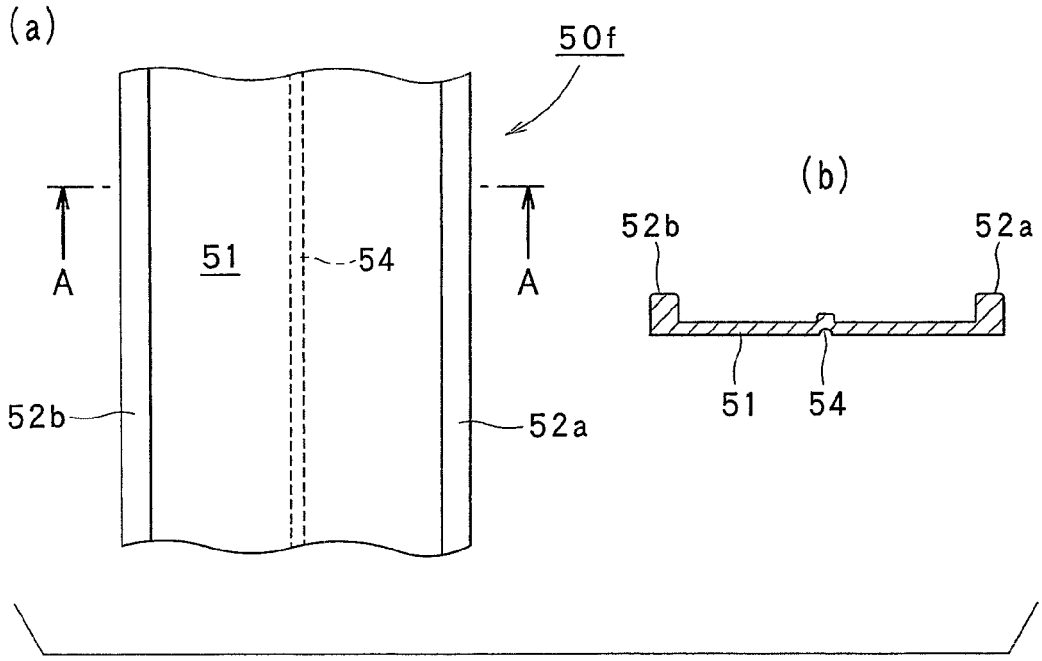
FIG. 16 is an enlarged diagram illustrating the construction of a tape-shaped sheet material that, in use, is applied to a spout port part in a bag with a pouring spout in a second aspect of the present invention, wherein FIG. 16 (*a*) is a typical plan view and FIG. 16 (*b*) a typical cross-sectional view taken on line A-A of FIG. 16 (*a*).

A tape shaped sheet material 50*f* shown in FIG. 16 has the same construction as the tape shaped sheet material 50*e* shown in FIG. 15, except that only the folding line 53 provided by line pressing along the flow direction at the center part in the widthwise direction of the tape base material 51 is changed to a filing line 54 by providing a reduced thickness part.

Also in this case, as with the tape shaped sheet material 50*c* shown in FIG. 13, the folding line 54 by providing a reduced thickness part may be formed by notching, in a concave form, the surface of the tape base material 51 on the convex-shaped streaks 52*a*, 52*b* side.

In the present invention, the above tape shaped sheet material is preferably used in such a manner that the tape shaped sheet material is prepared as a continuous wound roll and, when applied to the spout port part in the bag, is cut into a necessary length while drawing the tape shaped sheet material from the roll and is then applied to the spout port part in the bag. According to this method, the application of the tape shaped sheet material to the spout port part of the bag can be carried out inline with bagmaking. Therefore, the bag with a pouring spout to which a tape shaped sheet material has been applied can be produced with good productivity.

Figure 17:
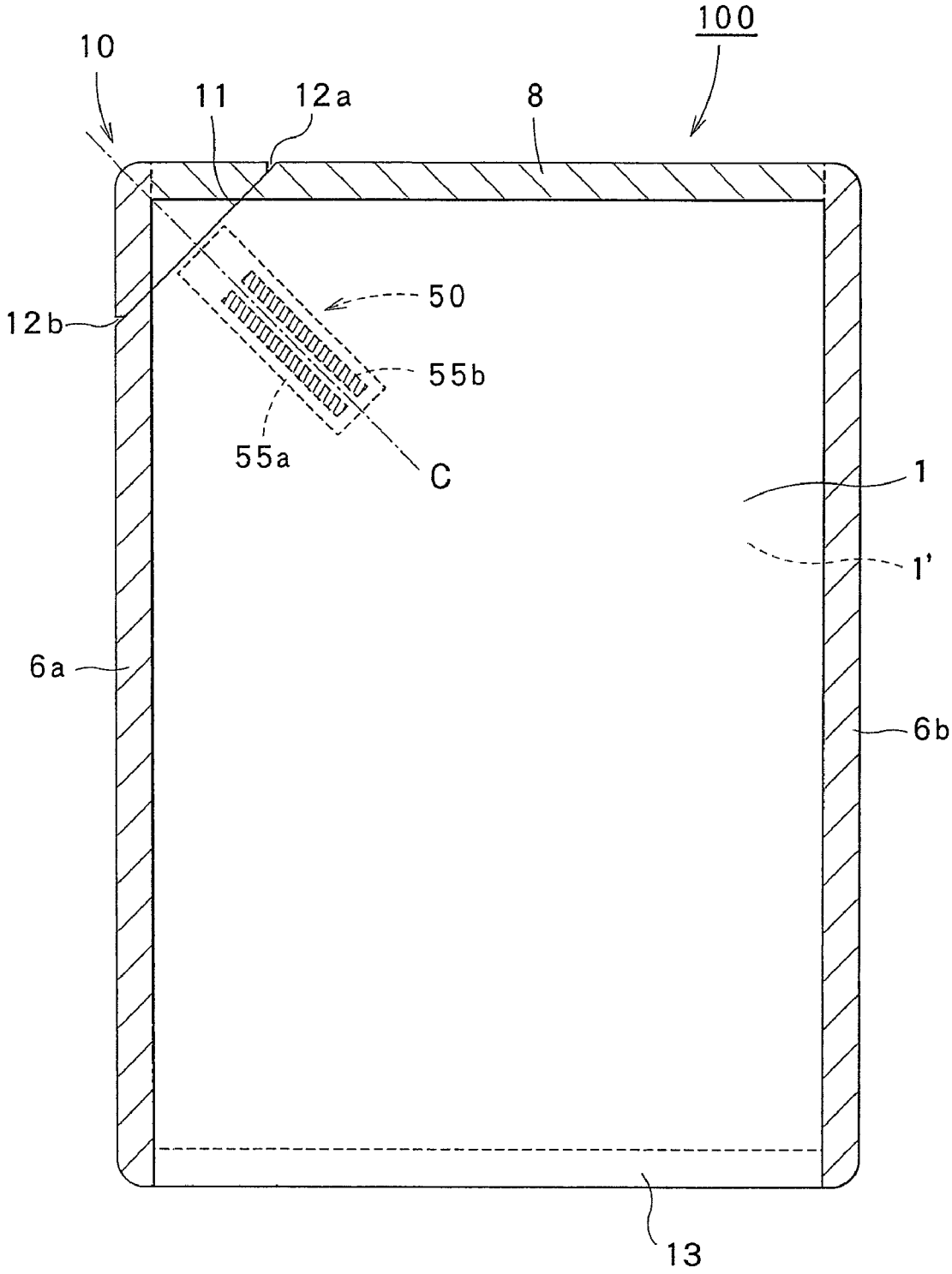
FIG. 17 is a typical plan view showing the construction of an embodiment of the bag with a pouring spout according to the second aspect of the present invention.

FIG. 17 shows a bag 100 with a spout port part. In a four sided seal-type bag in which upper, lower, left and right four edge parts of front and rear wall surface films (laminated films) 1, 1' have been heat sealed by an upper seal part 8, a lower seal part 13, and side seal parts 6*a*, 6*b*, before filling of contents, the lower seal part 13 is an unsealed opening part and functions as a filling port for contents. One corner part (in the drawing, a left corner part) in the upper part is used as a spout port part 10 for contents of the bag. In the opening position, a halfcut line 11 is provided, and notches 12*a*, 12*b* are provided at both-side ends of the halfcut line 11. Further, a tape shaped sheet material 50 is applied in a pattern as shown in tape shaped sheet material applied parts 55*a*, 55*b* on the inner surface of wall surface films 1,1' in the spout port part 10 along the center line C of the spout port part 10 from the halfcut line 11 in the opening position toward the center part in the bag 100.

The tape shaped sheet material 50 may have any construction of tape shaped sheet materials 50*a* to 50*f* shown in FIGS. 11 to 16.

For example, in the constructions of the tape shaped sheet materials 50*a* to 50*f* shown in FIGS. 11 to 16, the application pattern in applying the tape shaped sheet material 50 to the inner surface of the wall surface films 1, 1' in the spout port part 10 may be applied to substantially the whole area of the tape base material 51. More preferably, however, as shown in the tape shaped sheet material applied parts 55*a*, 55*b* shown in FIG. 17, the application pattern is applied in the opening position of the spout port part 10, that is, the region excluding a part near the halfcut line 11, in the form of two split strips.

The reason for this is as follows. Specifically, in the case of the application of the tape shaped sheet material to substantially the whole area of the tape base material 51, for example, when the tape shaped sheet material 50 and the halfcut line 11 cross each other due to shifting of the application position of the tape shaped sheet material 50 toward the front end side of the spout port part 10, the opening of the spout port part 10 by utilizing the halfcut line 11 becomes impossible due to obstruction by the tape shaped sheet material 50. When the tape shaped sheet material is applied to the area excluding the part near the halfcut line 11, even though the tape shaped sheet material 50 and the halfcut line 11 cross each other due to shifting of the application position of the tape shaped sheet material 50 by about several mm toward the front end side of the spout port part 10, the spout port part 10 in its opening position can be torn off in line with the halfcut line 11 to open the spout port part 10 without any problem. The application pattern of the tape shaped sheet material 50 may be split into two strips as shown in the tape shaped sheet material applied parts 55*a*, 55*b*. In this case, even when a folding line 53 by line pressing and a folding line 54 by providing a reduced thickness part are provided in the tape base material 51 in the tape shaped sheet material along the center line in the flow direction, the folding effect is not lost.

Figure 18:
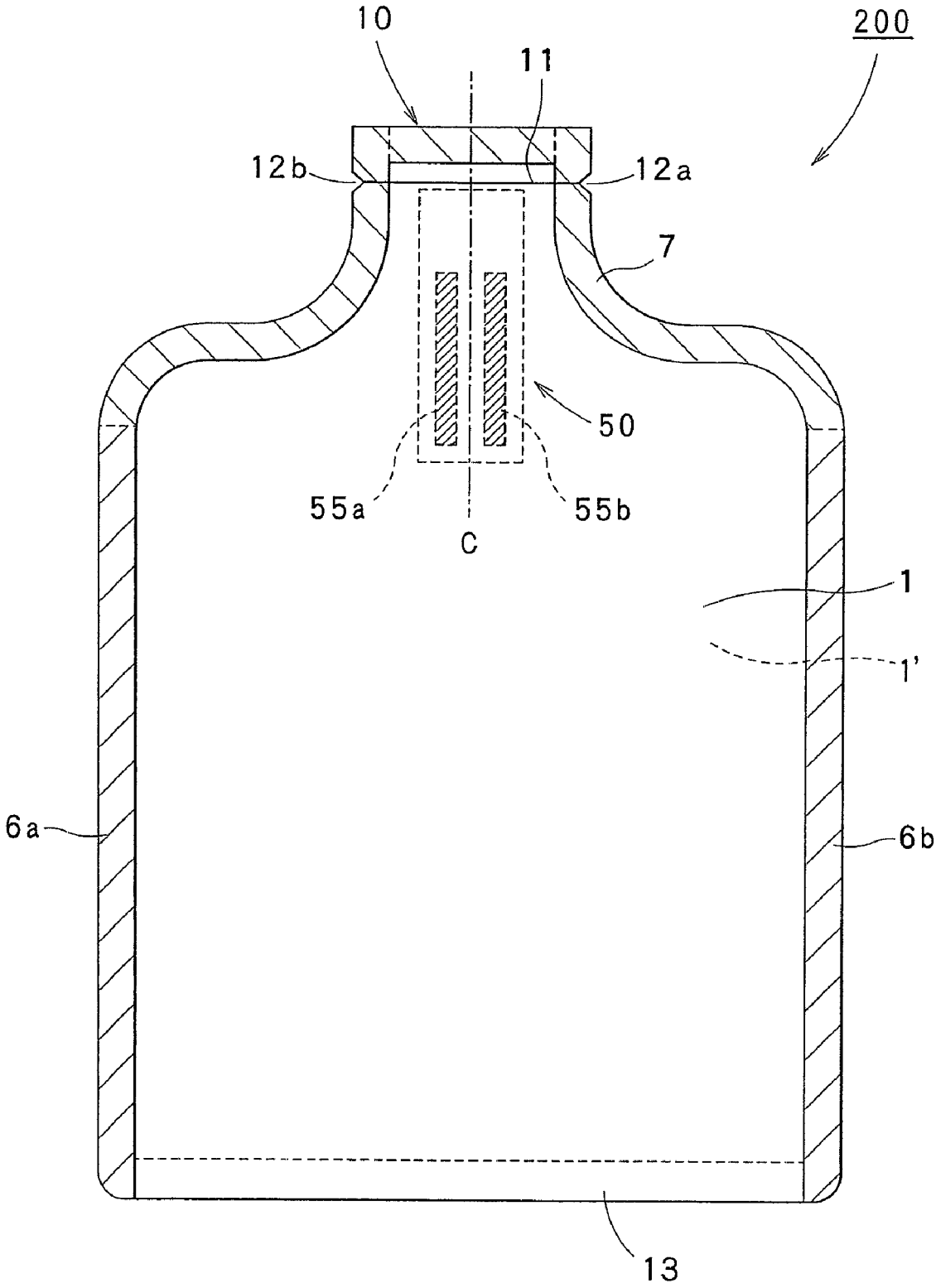
FIG. 18 is a typical plan view showing the construction of an embodiment of the bag with a pouring spout according to the second aspect of the present invention.

FIG. 18 shows a bag 200 with a spout port part has the same construction as the bag 100 with a spout port part shown in FIG. 17, except that the position of the spout port part 10 provided in one corner part in the upper part of the bag 100 is changed to the center part in the upper part of the bag. To this end, both sides of the spout port part 10 and the upper edge part are heat sealed by a spout port part seal part 7 and, further, both sides are notched to provide the spout port part 10 which are protruded upward. A halfcut line 11 is provided at an opening position near the front end of the spout port part 10, and notches 12*a*, 12*b* are provided at both ends of the halfcut line 11. Further, the tape shaped sheet material 50 is applied to the inner surface of the wall surface films 1, 1' in the spout port part 10 from the opening position, that is, the halfcut line 11 toward the center part of the bag 200 along the center line C of the spout port part 10 in a pattern as shown in tape shaped sheet material applied parts 55*a*, 55*b*. The construction other than the above points is the same as that of the bag 100 with a spout port part shown in FIG. 17.

Figure 19:
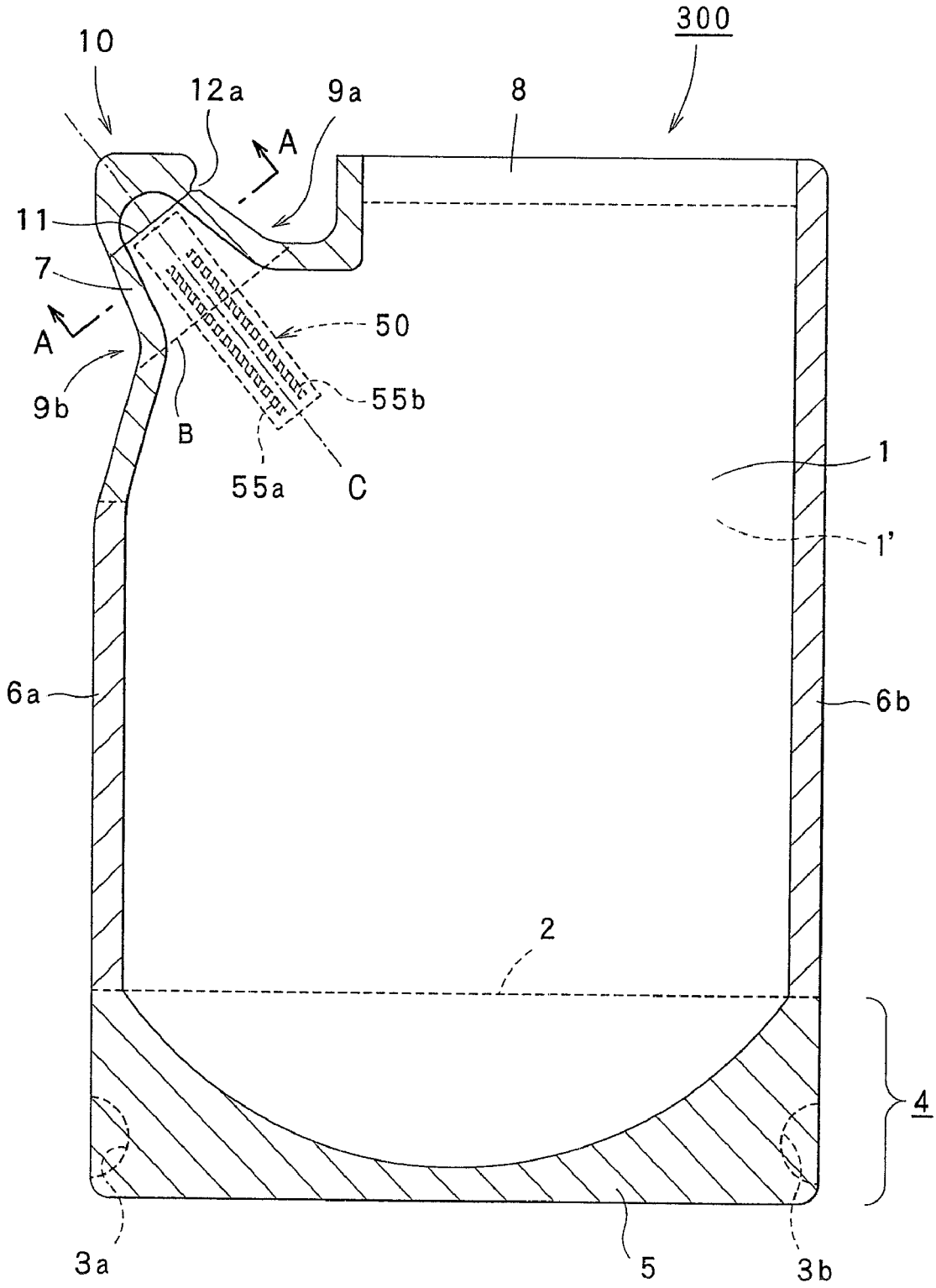
FIG. 19 is a typical plan view showing the construction of an embodiment of the bag with a pouring spout according to the second aspect of the present invention.

FIG. 19 shows a bag 300 with a spout port part. In this bag 300 with a spout port part, the body part and bottom are provided in a standing pouch form. Specifically, the bottom of the bag is formed so as to have a gusset part 4 in which a bottom film is inserted in an inward folded state into between front and rear wall surface films 1, 1' on their lower parts to a bottom film folded part 2. Semicircular bottom film notch parts 3*a*, 3*b* are provided near the lower end of both sides of the inward folded bottom film. The gusset part 4 is formed by heat sealing by a ship bottom-shaped bottom seal part 5 in which the inner side is a concave form defined by a line which is curved from both sides toward the central part. The body part of the bag is formed by heat sealing of the edge part of both sides of the front and rear wall surface films 1, 1' by side seal parts 6*a*, 6*b*. A spout port part 10, of which the front end part and side part both sides have been heat sealed by a spout port part seal part 7, has a tapered shape, and faces in an oblique outward upward direction, is provided in a protruded form at one corner part (in the drawing, a left corner part) in the upper part of the bag 300 by providing notches 9*a*, 9*b* on both sides of the spout port part 10.

Further, a halfcut line 11 is provided in the opening position near the front end of the spout port part 10, and a notch 12*a* is provided at the upper end of the halfcut line 11. Further, the tape shaped sheet material 50 is applied to the inner surface of the wall surface films 1, 1' in the spout port part 10 by a length extended from the opening position, that is, the halfcut line 11, toward the center part of the bag 300 along the center line C of the spout port part 10 in a pattern as shown in tape shaped sheet material applied parts 55*a*, 55*b*, to a position beyond a line B indicating the base of the spout port part.

In the upper part of the bag 300, the part not provided with the spout port part 10 is heat sealed by an upper seal part 8. This part, however, is used as a filling port for contents. Therefore, before filling of the contents, this part is an unsealed opening part, and, after the filling of the contents, the opening part is heat sealed.

Figure 20:
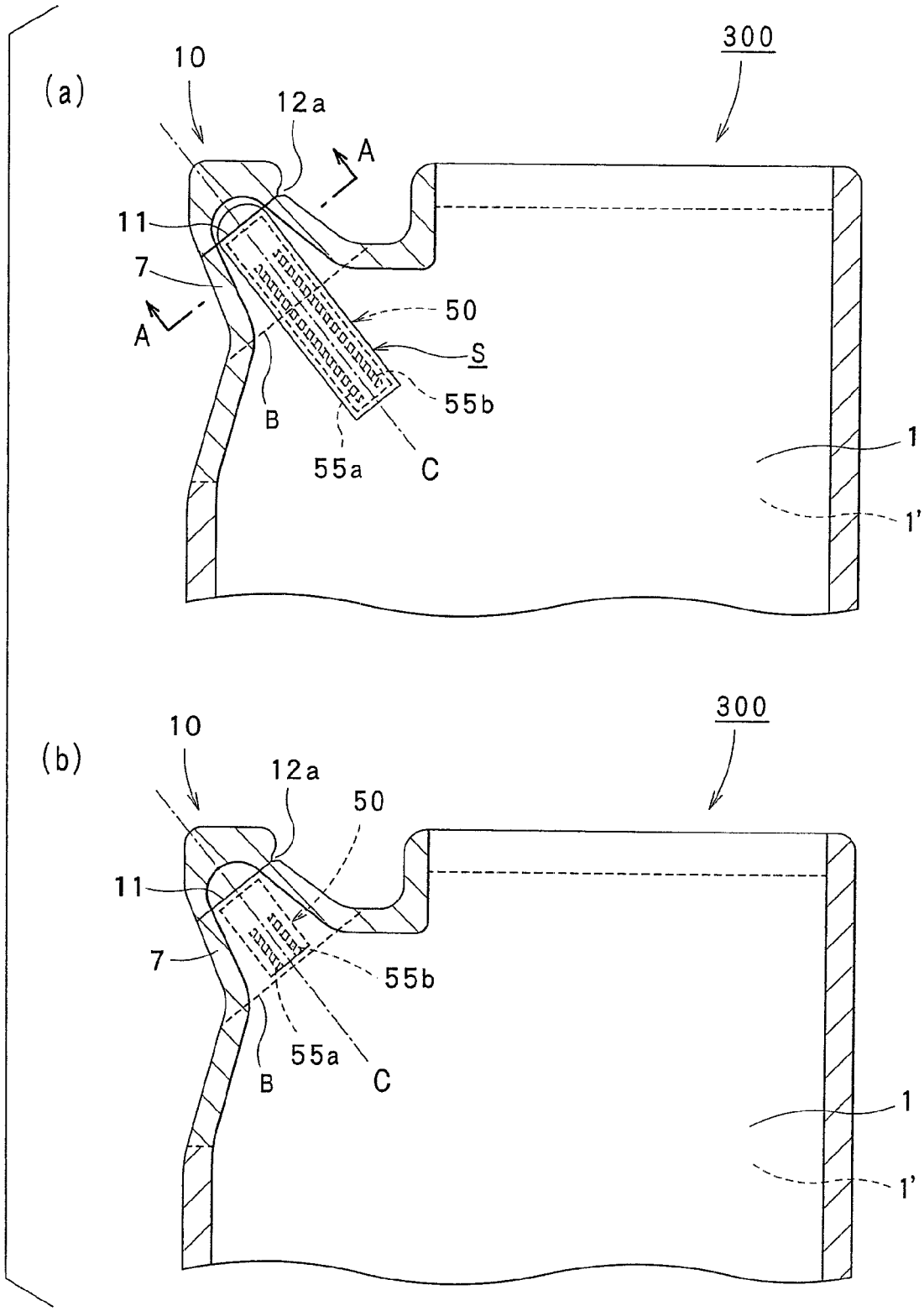
FIGS. 20 (*a*) and 20 (*b*) are typical plan views showing the construction of embodiments of the bag with a pouring spout according to the second aspect of the present invention.

FIG. 20 (*a*) shows a bag 300*a* with a spout port part. The bag 300*a* with a spout port part has the same construction as the bag 300 with a spout port part shown in FIG. 19, except that, before the tape shaped sheet material 50 is applied to the inner surface of the wall surface films 1,1' in the spout port part 10 provided at one corner part in the upper part of the bag along the center line C, as shown in the drawing, an emboss part S, which is bulged outward in substantially the same shape as the tape shaped sheet material 50, is provided, and the tape shaped sheet material 50 is applied to the inner surface of the emboss part S in a pattern shown in the tape shaped sheet material applied parts 55*a*, 55*b*.

The adoption of this construction can prevent the deviation of the position in the application of the tape shaped sheet material 50 to the inner surface of the wall surface films 1,1' in the spout port part 10. Further, even when the height of the tape shaped sheet material 50, particularly the height of the convex-shaped streaks 52*a*, 52*b*, is relatively high, pulling of the film in heat sealing of the spout port part seal part 7 can be avoided and, consequently, cockling in this part can be prevented, contributing to improved heat seal stability.

FIG. 20 (*b*) shows a bag 300*b* with a spout port part. The bag 300*b* with a spout port part has the same construction as the bag 300 with a spout port part shown in FIG. 19, except that, in the application of the tape shaped sheet material 50 to the inner surface of the wall surface films 1,1' in the spout port part 10 provided at one corner part in the upper part of the bag along the center line C, the length of the tape shaped sheet material 50 is shortened to a value extended from the opening position of the spout port part 10, that is, from the halfcut line 11, to a line B indicating the base of the spout port part in a pattern shown in the tape shaped sheet material applied parts 55*a*, 55*b*.

When this construction is adopted, attaining the effect of preventing the spout port part 10 from being clogged by folding of the spout port part 10 at a part near the base of the spout port part 10 in the spouting of the contents of the bag 300*b* with the spout port part is difficult. Since, however, the effect of easily opening the spout port part 10 in a cylindrical form with good shape retention is satisfactory, the fundamental effect of improving the suitability for spouting of the contents is satisfactory.

Figure 21:
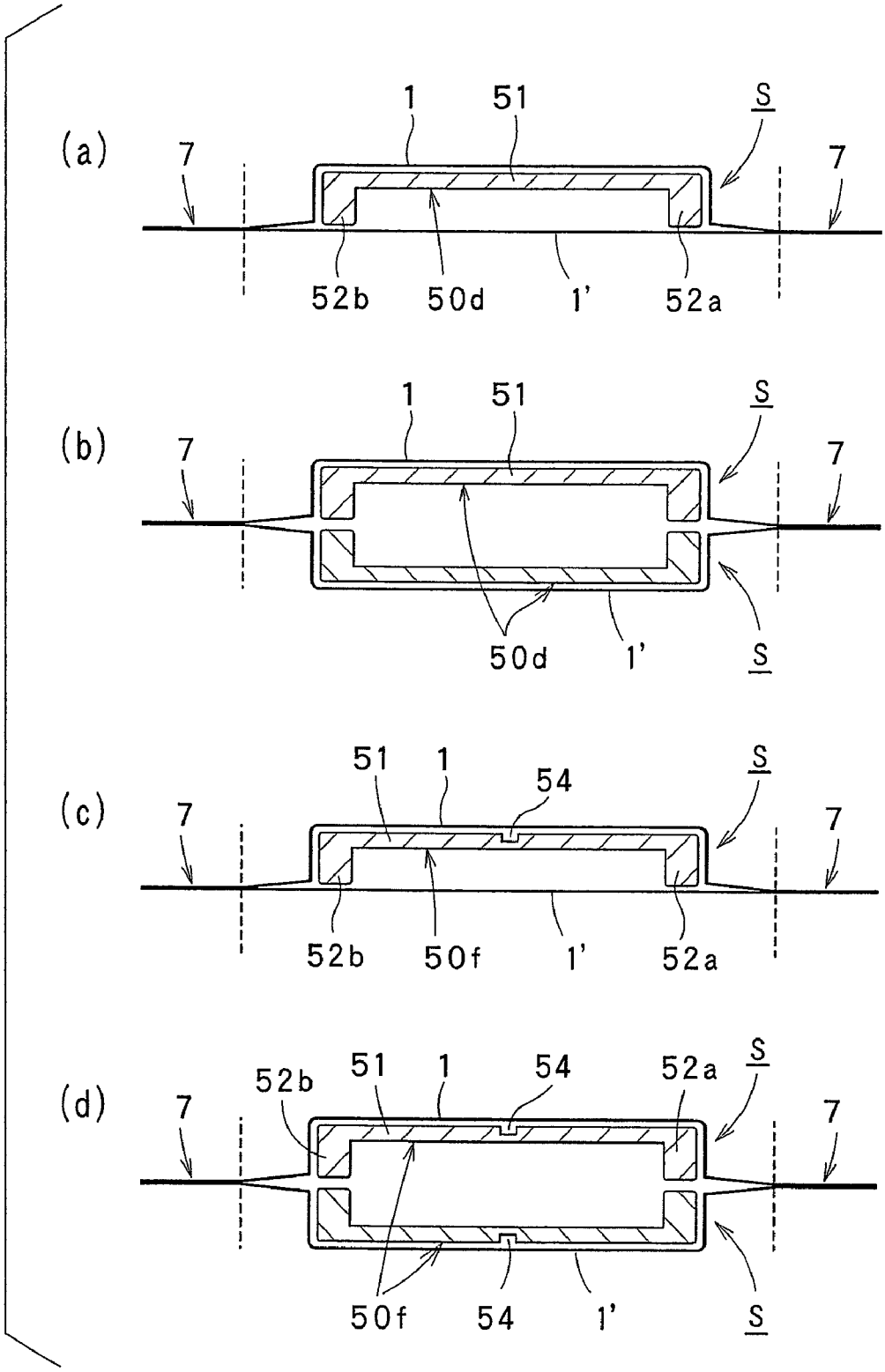
FIGS. 21 (*a*) to 21 (*d*) are enlarged cross-sectional views taken on line A-A of FIG. 20 (*a*).

FIG. 21 (*a*) is a diagram showing an embodiment where an outward bulged emboss part S is provided on one wall surface film 1 in both wall surface films 1, 1' in the spout port part 10, and the tape shaped sheet material 50*d* shown in FIG. 4 is inserted into and applied to the inner side of the emboss part S.

In this case, in the sectional part taken on line A-A in the drawing, the tape shaped sheet material 50*d* is not applied to the inner surface of the wall surface film 1 and is in such a state that is housed within the emboss part S.

When the tape shaped sheet material 50*d* is applied to the spout port part 10 in the bag 300*a* with a spout port part (see FIG. 20 (*a*)), a space is surely formed by the tape shaped sheet material 50*d* between the wall surface films 1, 1' on both sides of the spout port part 10. Therefore, in spouting the contents of the bag 300*a*, the spout port part 10 is automatically opened by opening the front end of the spout port part 10 along the half cut line 11. Subsequently, the spout port part 10 can easily be opened in a cylindrical form by pressing the both-side spout port part seal parts 7 from both sides toward the center part.

At that time, in the tape shaped sheet material 50*d*, the tape base material 51 is curved in a gutter form in the longitudinal direction. Therefore, the shape retention of the cylindrically opened spout port part 10 is also improved, and the contents can be smoothly spouted until the bag is completely emptied.

Also for the bag with a pouring spout shown in FIG. 21 (*b*), in the sectional part taken on line A-A in the drawing, the tape shaped sheet material 50*d* on both sides is not applied to the inner surface of the wall surface films 1, 1' and is housed within the emboss part S. This is true of FIGS. 21 (*c*) and 21 (*d*) which will be described below.

As shown in FIG. 21 (*b*), when the tape shaped sheet material 50*d* is applied to the both-side wall surface films 1, 1' in the spout port part 10 of the bag 300*a*, a larger space than the space in FIG. 21 (*a*) is provided between the both-side wall surface films 1, 1' in the spout port part 10. In this case, the spout port part 10 is automatically opened more largely by opening the spout port part 10 in line with the halfcut line 11. Pressing the both-side spout port part seal part 7 from both sides toward the center part allows the both-side tape shaped sheet material 50*d* to be curved outward in a gutter form, and, thus, the spout port part 10 can easily be opened in a cylindrical form. Further, the shape retention of the cylindrically opened spout port part 10 is further improved, and, thus, the contents can be more smoothly spouted until the bag is completely emptied.

Further, as shown in FIG. 21 (*c*), also when the tape shaped sheet material 50*f* is applied to the inner surface of the wall surface film 1 on one side of the spout port part 10, as with the case of FIG. 11 (*a*), a space is surely provided by the tape shaped sheet material 50*f* between the both-side wall surface films 1, 1' in the spout port part 10. Accordingly, the spout port part 10 is automatically opened by opening the spout port part 10 in line with the halfcut line 1,1. The spout port part 10 can easily be opened in a cylindrical form by pressing both-side spout port part seal parts 7 in the spout port part 10 from both sides toward the center part. In this case, since a folding line 54 by providing a reduced thickness part is provided in the center part in the widthwise direction of the tape base material 51 in the flow direction, the tape shaped sheet material 50*f* is folded outward in a V form. Consequently, by virtue of the rib effect attained by the outward folding, the shape retention of the cylindrically opened spout port part 10 is also improved, and the contents can be smoothly spouted until the bag is completely emptied.

FIG. 21 (*d*) is a diagram showing an embodiment where an outward bulged emboss part S is provided on both-side wall surface films 1,1' in the spout port part 10, and the tape shaped sheet materials 50*f* having a construction shown in FIG. 6 are inserted into and applied to the inner sides of the respective emboss parts S so that the convex-shaped streaks face each other.

When the tape shaped sheet materials 50*f* are applied to the inner surface of the spout port part 10, as with the case of FIG. 21 (*b*), a large space is provided by the both-side tape shaped sheet materials 50*f* between the both-side wall surface films 1, 1' in the spout port part 10. Therefore, the spout port part 10 is automatically opened largely by opening the spout port part 10 in line with the halfcut line 11. Subsequently, when the both-side spout port part seal part 7 in the spout port part 10 is pressed from both sides toward the center part, the both-side tape shaped sheet materials 50*f* each are folded outward in a V form at the folding lines 54 provided by the reduced thickness part. Consequently, the spout port part 10 can easily be opened in a prismatic form with good shape retention, and the contents of the bag can be smoothly spouted until the bag is completely emptied.

A laminated film composed mainly of plastic is mainly used as the laminated film used in the bag with a pouring spout according to the present invention. In a simple construction, a laminated film having a construction comprising a sealant layer stacked onto a base material film layer is used. Further, a laminated film having the same construction as the above construction except for the stacking of a layer for gas barrier against water vapor and the like, a light shielding layer, a strengthening layer and the like, for example, between the base material film layer and the sealant layer may be used depending upon the contents of the bag, service conditions such as whether or not heat treatment is carried out after the filling of the contents, or necessary properties such as gas barrier properties against water vapor and the like, light shielding properties, and various types of mechanical strength.

The above base material film layer, layer for gas barrier against water vapor and the like, light shielding layer, strengthening layer, sealant layer and the like each may be formed either solely or as a laminate of a plurality of layers.

Biaxially stretched films of polyesters such as polyethylene terephthalate and polyethylene naphthalate, and, further, biaxially stretched films of polyamides such as nylon 6, nylon 66, MXD6 (poly-m-xylyleneadipamide, biaxially stretched polypropylene films and the like are suitable for use in the base material film layer.

These films may be used either solely or as a laminate of a combination of two or more of them.

Materials usable for the gas barrier layer include films of saponification products of ethylene-vinyl acetate copolymers (EVOHs), polyvinylidene chloride (PVDCs), polyacrylonitrile (PANs), and, further, aluminum foils, or biaxially stretched nylon films (ON films) provided with a vapor deposited layer of silica, alumina or aluminum, or a coating layer of PVDC, biaxially stretched polyethylene terephthalate films (PET films), and biaxially stretched polypropylene films (OPP films).

Among them, the aluminum foil or the film provided with the aluminum deposited layer are opaque and thus can function also as a light shielding layer.

Any of the above base material films may be properly additionally stacked as the strengthening layer, and, for example, a biaxially stretched high-density polyethylene film may be stacked as both a strengthening layer and a moisture barrier layer.

The gas barrier layer, light shielding layer, and strengthening layer may be stacked onto the base material film layer by conventional dry lamination or extrusion lamination (sandwich lamination).

Materials usable for the sealant layer include low-density polyethylenes (LDPEs), linear low-density polyethylenes (L•LDPEs), medium-density polyethylenes (MDPEs), high-density polyethylenes (HDPEs), and, further, ethylene copolymers such as ethylene-α-olefin copolymers, ethylene-vinyl acetate copolymers (EVAs), ethylene-acrylic acid copolymers (EAAs), ethylene-methacrylic acid copolymers (EMAA), ethylene-acrylic ester copolymers, ethylene-methacrylic ester copolymers and ionomers, polypropylenes, and propylene copolymers.

Methods for sealant layer lamination include a method in which the above resin is formed into a film followed by dry lamination or extrusion lamination, or a method in which the above resin is extrusion coated for lamination. When the contents are likely to permeate into the sealant layer, lamination by the dry lamination is preferred.

(3) Method for Manufacturing Bag with Pouring Spout

Next, a method for manufacturing the bag with a pouring spout according to the present invention will be described.

The form of the bag per se in the bag with a pouring spout according to the present invention is not particularly limited. Examples thereof include flat pouch-type bags such as three sided seal-type, four sided seal-type, or pillow-type bags, and standing pouch-type bags.

Accordingly, fundamentally, a bag making machine for manufacturing an adopted type of bag is utilized. The adopted type of bag can easily be manufactured by using the bag making machine in proper combination with a heat sealing device for providing a spout port part in the bag, a punching device for providing a notch part or a notch on both sides of the spout port part, a tape shaped sheet material mounting device for cutting the tape shaped sheet material into a predetermined length and applying the cut material, for example, in a spot form, to the spout port part, a hot pressing device for thermoforming the mounted tape shaped sheet material and the laminated film on the outer side of the tape shaped sheet material into an outward bulged gutter and, at the same time, welding the tape shaped sheet material and the outer laminated film to each other, an emboss device for providing the emboss part in the spout port part, and a laser beam irradiation device for providing the halfcut line.

EXAMPLES

The bag with a pouring spout according to the present invention will be described in more detail with reference to the following Examples. However, it should be noted that the present invention is not limited to the Examples only.

Bag with Pouring Spout According to First Aspect

1. Preparation of Bag 1 with Spout Port Part

Example 1

A bag 200 with a spout port part having a construction shown in FIG. 5 having the following dimension was prepared, as a bag with a pouring spout of Example 1, using a laminated film having the following construction and a tape shaped sheet material having the following construction.

(1) Construction of Laminated Films 1, 1' for Wall Surface

Outer side: biaxially stretched nylon film (hereinafter referred to as "ON film") (thickness 15 μm)/adhesive/aluminum deposited (deposit thickness 400 angstroms) biaxially stretched polyethylene terephthalate film (hereinafter referred to as "aluminum deposited PET film") (thickness 12 m)/adhesive/linear low-density polyethylene film (hereinafter referred to as "L•LDPE film") (thickness 120 μm)

(2) Construction of Laminated Film for Bottom

Outer side: ON film (thickness 15 μm)/adhesive/aluminum deposited PET film (thickness 12 μm)/adhesive/L•LDPE film (thickness 90 μm)

For all the above cases in the lamination of the above films, dry lamination was adopted, and a two-component curing-type polyurethane adhesive for dry lamination was used as an adhesive for bonding between the films.

(3) Construction and Dimension of Tape Shaped Sheet Material

The tape shaped sheet material used had a width of 11 mm and a length of 30 mm. The tape shaped sheet material was formed so as to have a construction of a laminate of two layers shown in FIG. 1 (*c*). A thermally adhesive resin layer a to be applied to the laminated film in the bag was a low-density polyethylene layer (thickness 120 μm), and a layer b as the opposite-side layer was a medium-density polyethylene layer (thickness 140 μm). The total thickness of the tape shaped sheet material was 260 μm.

(4) Dimension of Bag with Pouring Spout, and Method for Mounting Tape Shaped Sheet Material to Spout Port Part The dimension of the bag was 135 mm in total width, 225 mm in total length, and 37 mm in interfolding length in a gusset part 4 at the bottom.

The spout port part was formed so as to have a shape shown in the drawing. The maximum width in the shape shown in the spout port part seal part 7 was 40 mm, and the maximum length was 55 mm. For details, the total width at the position where the halfcut line 11 was provided was 24 mm, and the taper angle of the spout port part 10 was approximately 36 degrees.

For the front end side of the spout port part, the position of the application of the tape shaped sheet material to the spout port part was about 1 mm inward from the halfcut line and was applied from that position toward the inside of the bag by a length of 30 mm substantially along the center line of the spout port part.

The application of the tape shaped sheet material to the spout port part was carried out by applying the tape shaped sheet material to the inner surface of the laminated films on both respective sides of the spout port part by spot sealing. Thereafter, the tape shaped sheet material and the laminated film on the outer side of the tape shaped sheet material were thermopressed, using a molding die 20 as shown in FIG. 2, into an outward bulged semicylindrical gutter shape in which the tape shaped sheet material and the laminated film had been welded to each other.

In the thermopressing, in the length 30 mm of the sheet material 50, only a 20 mm length in the middle part was thermopressed into a semicylindrical gutter shape while remaining a 2 mm length on the front end side of the spout port part and an 8 mm length on the inner side of the bag unthermopressed.

Further, regarding the halfcut line, each three parallel halfcut lines were provided at intervals of 0.7 mm on both sides of a central halfcut line. Further, two oblique halfcut lines were provided in an X form so that the two halfcut lines obliquely crossed the parallel halfcut lines.

Thus, a bag 1 with a spout port part of Example 1 was prepared.

2. Preparation of Bag 2 with Spout Port Part

Example 2

A bag 2 with a spout port part was prepared in the same manner as in Example 1, except that a forming die shown in FIG. 3 (*b*) was used, that is, in the construction of the bag with a pouring spout of Example 1, after the application of the tape shaped sheet materials to the inner surface of the laminated film on both respective sides of the spout port part, the sheet material and the laminated film on the outer side of the sheet material were thermoformed into an outward bulged gutter shape in which the sheet material and the laminated film had been welded to each other, using the forming die shown in FIG. 3 (*b*).

3. Preparation of Bag 3 with Spout Port Part

Example 3

A bag 3 with a spout port part was prepared in the same manner as in Example 1', except that a forming die shown in FIG. 3 (*c*) was used, that is, in the construction of the bag with a pouring spout of Example 1, after the application of the tape shaped sheet materials to the inner surface of the laminated film on both respective sides of the spout port part, the sheet material and the laminated film on the outer side of the sheet material were thermoformed into an outward bulged gutter shape in which the sheet material and the laminated film had been welded to each other, using the forming die shown in FIG. 3 (*c*).

4. Preparation of Bag 4 with Spout Port Part

Example 4

A bag 4 with a spout port part was prepared in the same manner as in Example 1, except that, in the construction of the bag with a pouring spout of Example 1, the construction of the laminate of the tape shaped sheet material applied to the inner surface of the laminated films on both respective sides of the spout port part was changed so that the thickness of the low-density polyethylene layer was 160 μm, the thickness of the medium-density polyethylene layer on the opposite side was 240 μm, and the total thickness was 400 μm, and, further, after the application, in the thermoforming into the gutter shape and welding, a forming die shown in FIG. 3 (*d*) was used.

Bag with Pouring Spout According to Second Aspect

5. Preparation of Bag 5 with Spout Port Part

Example 5

A bag 5 with a spout port part having a construction shown in FIG. 19 having the following dimension was prepared using the same laminated film and tape shaped sheet material as in Example 1.

(1) Construction and Dimension of Tape Shaped Sheet Material

The tape shaped sheet material had a construction shown in FIG. 14. The total width was 15 mm, and the tape base material 51 had a two-layer structure. In the two layers, the layer on the side of convex-shaped streaks 52*a*, 52*b* was a medium-density polyethylene layer (thickness 120 μm), and the other layer (the layer applied to the spout port part) was a low-density polyethylene layer (thickness 120 μm). That is, the total thickness was 240 μm. The convex-shaped streaks 52*a*, 52*b* were provided at the edge part on both sides so as to have a height including the tape base material 51 of 1.6 mm and a width of 1.5 mm.

The tape shaped sheet material was prepared by irregular shape coextrusion.

(2) Dimension of Bag with Pouring Spout

The dimension of the bag was 130 mm in total width, 190 mm in total length, and 38 mm in interfolding length in a gusset part 4 at the bottom.

The spout port part was formed so as to have a shape shown in FIG. 19. The total width in the opening position (that is, the position at which the halfcut line 11 was provided) was 26 mm, the length from the halfcut line to the line B indicating the base of the spout port part was about 20 mm, and the taper angle of the spout port part 10 was 38 degrees.

The length of the application of the tape shaped sheet material to the spout port part was defined as the length extended from the opening position (that is, the halfcut line 11) in the spout port part to the position which was 15 mm beyond the line B indicating the base of the spout port part, and the total length was 35 mm.

As shown in FIG. 21 (*a*), the application of the tape shaped sheet material to the spout port part was carried out for only one-side wall surface film in the wall surface films on both respective sides of the spout port part. The construction in this Example is different from the construction shown in FIG. 21 (*a*) in that any emboss part S was not provided.

6. Preparation of Bag 6 with Spout Port Part

Example 6

The bag 6 with a spout port part was prepared in the same manner as in Example 5, except that, in the construction of the bag with a pouring spout in Example 5, as shown in FIG. 21 (*b*), the tape shaped sheet material was applied to the wall surface film on both sides of the spout port part so that the convex-shaped streaks on the tape shaped sheet materials faced each other.

7. Preparation of Bag 7 with Spout Port Part

Example 7

A bag 7 with a spout port part was prepared in the same manner as in Example 5, except that, in the construction of the bag with a pouring spout in Example 5, the tape shaped sheet material applied to the spout port part was changed to that having a construction shown in FIG. 16.

8. Preparation of Bag 8 with Spout Port Part

Example 8

A bag 8 with a spout port part was prepared in the same manner as in Example 5, except that, in the construction of the bag with a pouring spout in Example 5, the tape shaped sheet material applied to the spout port part was changed to that having a construction shown in FIG. 16 and, further, as shown in FIG. 21 (*d*), the tape shaped sheet material was applied to the wall surface films on both sides of the spout port part so that the convex-shaped streaks on the tape shaped sheet materials faced each other.

Test and Results Thereof

The bags with a spout port part of Examples 1 to 8 prepared above were evaluated for suitability for spouting as follows. An about 400 ml of a liquid detergent was filled as contents from the unsealed upper seal part 8 into each bag with a pouring spout, and the upper seal part 8 was then hermetically heat sealed.

All the packages using the bags with a spout port part had excellent self-standing properties and, at the same time, had good appearance and handleability.

Next, a test on suitability for spouting of the liquid detergent filled into each package was carried out as follows. Specifically, the front end of the spout port part of each package was hand picked, and the spout port part was torn off from the notch as the starting point along the half cut line. As a result, for all the packages, the spout port part 10 was well torn off along the halfcut line to open the spout port part 10.

Although all the packages were somewhat different from each other in opening shape, simultaneously with opening of the spout port part, the spout port part 10 was automatically opened in a cylindrical form with good shape retention. The spout port part could easily be opened in a cylindrical form by merely lightly pressing the spout port part seal part by the hand from both sides toward the center part. In particular, for the packages of Examples 6 and 8, by virtue of the application of the tape shaped sheet material to the wall surface films on both sides of the spout port part, the shape retention of the cylindrically opened opening part was excellent, and the cylindrical opening part was stable.

Next, the opened spout port part was inserted into the mouth part (inner diameter of the mouth part: 26 mm) of a separately provided bottle, and the packed liquid detergent was spouted into the bottle. As a result, it was found that, for all the packages, the liquid detergent could be smoothly spouted until the package was completely emptied without causing clogging of the spout port part 10 during spouting of the liquid detergent, that is, all the packages had excellent suitability for spouting.

The invention claimed is:

1. A bag with a pouring spout, comprising a narrow-width spout port part provided at one end of a laminated film bag, wherein in a region of the spout port part, a tape-shaped sheet material, which has been cut into a desired length, is applied to the inner surface of at least one of laminated films provided on both sides of the bag, said tape-shaped sheet material further comprises two side edge parts, wherein a convex-shaped streak is provided on at least one of said two side edge parts of said tape-shaped sheet material, and a width of said convex-shaped streak is in a range of 1 to 2 mm and a height of said convex-shaped steak is in a range of 1 to 3 mm.

2. The bag with a pouring spout according to claim 1, wherein the laminated film and the tape-shaped sheet material applied to the laminated film have been thermoformed into a gutter shape which has been bulged outward in the bag and in which the laminated film and the tape shaped material have been welded to each other.

3. The bag with a pouring spout according to claim 1, wherein a folding line formed by line pressing or thickness reduction of the sheet is provided in the tape-shaped sheet material along the center line in its longitudinal direction.

4. The bag with a pouring spout according to claim 1, wherein the tape-shaped sheet material is formed of a laminate of two or more layers, the layer applied on the laminated film side is formed of a thermal adhesive resin, and the layer on the other side is formed of either a resin having a melting point above the thermal adhesive resin or other thermoformable material.

5. The bag with a pouring spout according to claim 1, wherein the tape-shaped sheet material has been colored.

6. The bag with a pouring spout according to claim 1, wherein easy opening means is provided in the spout port part at its opening position.

7. The bag with a pouring spout according to claim 1, which is a standing pouch-type bag and wherein the spout port part is provided at one corner part in the upper part of the bag.

* * * * *